US007384118B2

(12) United States Patent
Tobita et al.

(10) Patent No.: US 7,384,118 B2
(45) Date of Patent: Jun. 10, 2008

(54) INK-JET RECORDING APPARATUS AND METHOD FOR DRIVING THE SAME

(75) Inventors: Manabu Tobita, deceased, late of Tsushima (JP); by Yukiko Tobita, legal representative, Tsushima (JP); Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 276 days.

(21) Appl. No.: 11/276,600

(22) Filed: Mar. 7, 2006

(65) Prior Publication Data

US 2006/0203030 A1 Sep. 14, 2006

(30) Foreign Application Priority Data

Mar. 8, 2005 (JP) ..... 2005-063365

(51) Int. Cl.
*B41J 2/165* (2006.01)

(52) U.S. Cl. ..... 347/23; 347/29; 347/30; 347/32; 347/33

(58) Field of Classification Search ..... 347/23, 347/29, 30, 32, 33
See application file for complete search history.

(56) References Cited

U.S. PATENT DOCUMENTS 5,717,443 A * 2/1998 Numata et al. ..... 347/16
5,831,644 A * 11/1998 Kato ..... 347/22
5,971,520 A * 10/1999 Nakahara ..... 347/30
6,312,093 B1 * 11/2001 Saijo et al. ..... 347/30
6,793,316 B2 9/2004 Sugimura et al.
2004/0227793 A1 11/2004 Takagi et al.

FOREIGN PATENT DOCUMENTS

JP 2002254677 A 9/2002

* cited by examiner

*Primary Examiner*—Shih-Wen Hsieh
(74) *Attorney, Agent, or Firm*—Baker Botts L.L.P.

(57) ABSTRACT

An ink-jet recording apparatus has a pick-up roller for supplying to a conveyor mechanism an uppermost one of record media on a supporter, an elevator for moving up and down the supporter, a pump for forcibly ejecting ink within an ink-jet head, a drive shaft that is rotated both in positive and negative directions by a drive source, and a driving force transmitter. The driving force transmitter is capable of switching its mode between a mode for transmitting rotating force of the drive shaft in the positive direction to the pump so as to drive the pump and a mode for transmitting rotating force of the drive shaft in the negative direction to the pick-up roller so as to drive the pick-up roller. After the elevator is controlled to bring the uppermost one of the record media on the supporter away from the pick-up roller, the drive source is controlled to rotate the drive shaft in the positive direction.

12 Claims, 13 Drawing Sheets

INK-JET RECORDING APPARATUS AND METHOD FOR DRIVING THE SAME

BACKGROUND OF THE INVENTION

1. Field of the Invention

The present invention relates to an ink-jet recording apparatus that conducts recording by ejecting ink to a record medium, and also relates to a method for driving the ink-jet recording apparatus.

2. Description of Related Art

Japanese Patent Unexamined Publication No. 2002-254677 discloses an ink-jet recording apparatus that conducts a printing by reciprocating a carrier having a recording head mounted thereon and in this state ejecting ink from nozzles of the recording head to a paper fed by a paper-feed roller. This ink-jet head performs a purge operation by forcibly sucking, through the nozzles, ink staying within the recording head. This ink-jet recording apparatus includes a paper feed roller, a cap, an AP motor, a driving force transmitter, a pump, a conveyor roller, an LF motor (Line Feed motor), and a clutch mechanism. The paper feed roller sends out a paper to the conveyor roller. In a purge operation, the cap covers an ink ejection face of the recording head in which many nozzles are formed. The AP motor drives the paper feed roller and the cap. The driving force transmitter transmits positive rotating force of the AP motor to the paper feed roller and negative rotating force of the AP motor to a mechanism for moving the cap up and down. The pump is connected through a tube to the cap. The LF motor drives the conveyor roller and the pump. The clutch mechanism drives the conveyor roller while driving the pump so as to rub the tube disposed in the pump when the LF motor rotates in a positive direction, and drives the pump so as not to rub the tube disposed in the pump when the LF motor rotates in a negative direction. The mechanism for moving the cap up and down has a planet lock cam that holds the clutch mechanism in such a position that rotating force of the LF motor may not be transmitted to the pump.

In order to perform a printing in this ink-jet recording apparatus, the AP motor is rotated in the positive direction to thereby drive the paper feed roller through the driving force transmitter, so that a paper is sent out onto the conveyor roller. Then, the LF motor is rotated in the positive direction to thereby drive the conveyor roller, and at the same time ink is ejected from the recording head while the carrier is reciprocating. At this time, the pump is not driven by rotation of the LF motor, because the planet lock cam holds the clutch mechanism in such a position such that rotating force of the LF motor may not be transmitted to the pump.

In order to perform a purge operation in this ink-jet recording apparatus, the AP motor is rotated in the negative direction, so that the cap is moved up through the driving force transmitter and the mechanism for moving the cap up and down. Thereby, the cap is brought into close contact with the ink ejection face of the recording head so as to cover the head. At this time, the planet lock cam is released, and the clutch mechanism becomes free. By rotating the LF motor in the positive direction, the pump is driven through the clutch mechanism. This produces negative pressure inside the cap, so that ink is sucked from the recording head.

Like this, a single motor is operated in different manners, i.e., rotated in positive and negative directions. Therefore, it is not necessary to provide a driving motor dedicated to each operation.

SUMMARY OF THE INVENTION

In the ink-jet recording apparatus, each of the driving force transmitter and the clutch mechanism includes a set of sun gears, a planet gear, and other gears. When the AP motor and the LF motor rotate, the respective sun gears rotate, and the planet gear corresponding to each sun gear swings around an axis of the sun gear. Depending on a rotation direction of the motor, a position of the planet gear changes, and a target to which rotating force of the motor is transmitted changes. However, if a purge operation is performed in a state where the planet gear of the driving force transmitter is engaged with a gear for transmitting rotating force of the AP motor to the paper feed roller, negative rotation of the AP motor causes the paper feed roller to rotate in a direction reverse to a direction of sending out a paper onto the conveyor roller. This may cause a malfunction such as flicking a paper out of a paper tray.

An object of the present invention is to provide an ink-jet recording apparatus which is downsized due to a reduced number of driving sources and at the same time capable of preventing a malfunction concerning a conveyance of a record medium, and also to provide a method for driving the ink-jet recording apparatus.

According to a first aspect of the present invention, there is provided an ink-jet recording apparatus comprises an ink-jet head, a conveyor mechanism, a supporter, a pick-up roller, an elevator, a pump, a drive shaft, a driving force transmitter, a purge controller, and an elevator controller. The ink-jet head has an ink ejection face on which a plurality of nozzles for ejecting ink to a record medium are formed. The conveyor mechanism conveys the record medium to a position confronting the ink ejection face. The supporter supports a plurality of record media. The pick-up roller supplies to the conveyor mechanism an uppermost one of the record media supported on the supporter. The elevator moves up and down the supporter. The pump forcibly ejects through the nozzles ink staying within the ink-jet head. The drive shaft is rotated both in positive and negative directions by a drive source. The driving force transmitter is capable of switching its mode between a mode for transmitting rotating force of the drive shaft in the positive direction to the pump so as to drive the pump and a mode for transmitting rotating force of the drive shaft in the negative direction to the pick-up roller so as to drive the pick-up roller. The purge controller controls the drive source so as to rotate the drive shaft in the positive direction in order that the pump is driven to forcibly eject through the nozzles ink staying within the ink-jet head. The elevator controller controls the elevator so as to bring the uppermost one of the record media supported on the supporter to one of a position in contact with the pick-up roller and a position away from the pick-up roller. After the elevator controller controls the elevator so as to bring the uppermost one of the record media supported on the supporter to the position away from the pick-up roller, the purge controller controls the drive source so as to rotate the drive shaft in the positive direction.

According to a second aspect of the present invention, there is provided a method for driving an ink-jet recording apparatus comprising an ink-jet head, an ink-jet head, a supporter, a pick-up roller, an elevator, a pump, a drive shaft, and a driving force transmitter. The ink-jet head has an ink ejection face on which a plurality of nozzles for ejecting ink to a record medium are formed. The conveyor mechanism conveys the record medium to a position confronting the ink ejection face. The supporter supports a plurality of record media. The pick-up roller supplies to the conveyor mechanism an uppermost one of the record media supported on the supporter. The elevator moves up and down the supporter. The pump forcibly ejects through the nozzles ink staying within the ink-jet head. The drive shaft is rotated both in positive and negative directions by a drive source. The driving force transmitter is capable of switching its mode between a mode for transmitting rotating force of the drive shaft in the positive direction to the pump so as to drive the pump and a mode for transmitting rotating force of the drive shaft in the negative direction to the pick-up roller so as to drive the pick-up roller. The method comprises a first elevator controlling step and a purge controlling step. The first elevator controlling step is for controlling the elevator so that the uppermost one of the record media supported on the supporter is moved from a position in contact with the pick-up roller to a position away from the pick-up roller. The purge controlling step is for, after the first elevator controlling step, controlling the drive source so as to rotate the drive shaft in the positive direction so that the pump is driven to thereby forcibly eject through the nozzles ink staying in the ink-jet head.

In the first aspect, the pump and the pick-up roller are driven separately in accordance with positive and negative rotation of the drive shaft rotated by the drive source. This leads to downsizing of the ink-jet recording apparatus. In the first and second aspects, before the purge controller controls the drive shaft so as to rotate in the positive direction to thereby drive the pump, the uppermost one of the record media supported on the supporter is moved to the position away from the pick-up roller. Therefore, even if at this time the drive shaft unintentionally rotates in the negative direction and the pick-up roller is driven, the record medium is not sent out to the conveyor mechanism. Thus, misfeeding of a record medium can be prevented.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

First, with reference to FIGS. 1 and 2, a description will be given to a general construction of an ink-jet head 1 according to an embodiment of the present invention. The ink-jet head 1 is a color ink-jet printer having four ink-jet heads 2.

Figure 1:
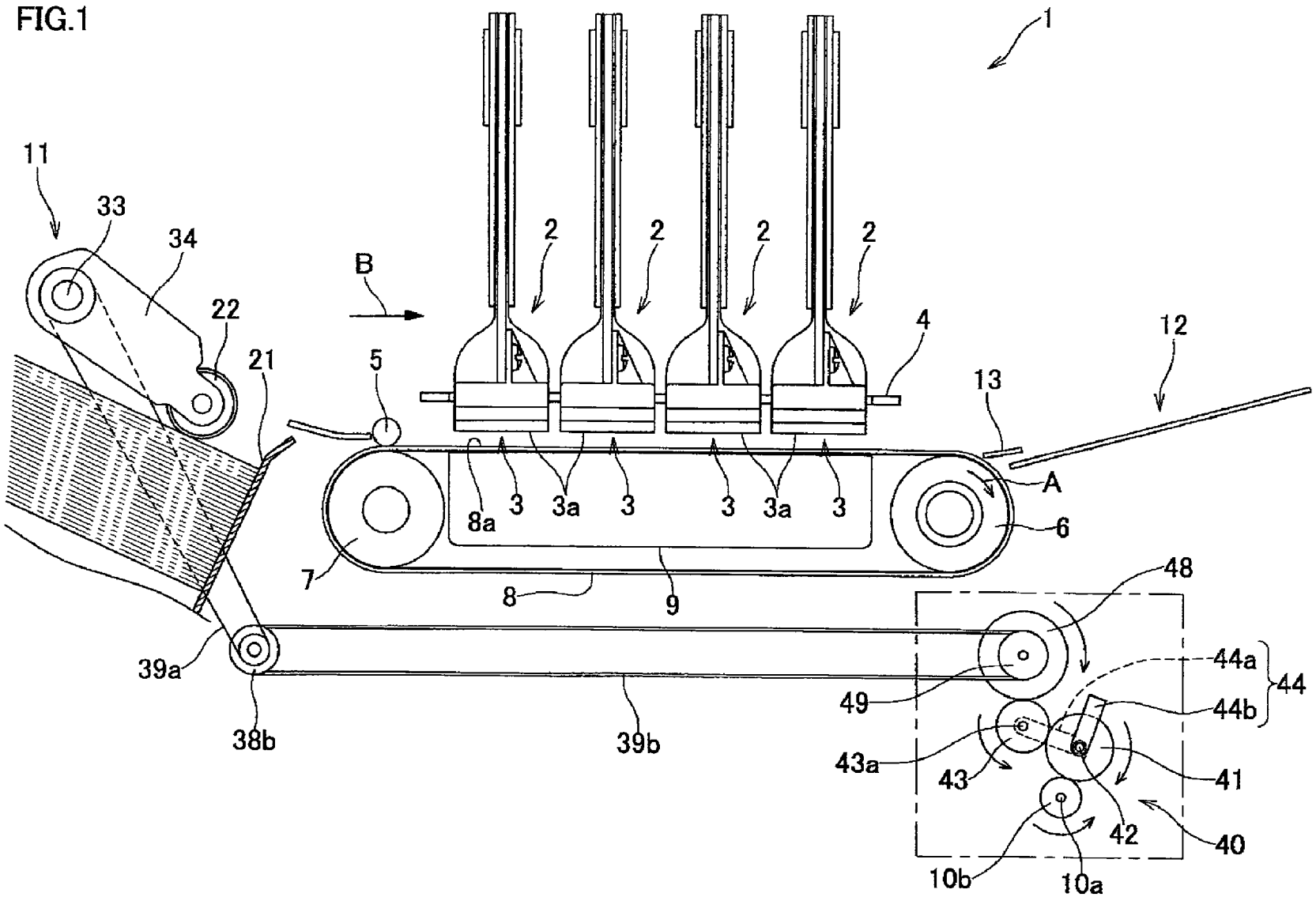
FIG. 1 schematically illustrates a side cross-section of an ink-jet printer according to an embodiment of the present invention.

The ink-jet printer 1 has a paper feeder 11 shown lefthand in FIG. 1 and a paper discharge tray 12 shown righthand in FIG. 1. Formed inside the ink-jet printer 1 is a paper conveyance path in which a paper as a record medium is conveyed from the paper feeder 11 toward the paper discharge tray 12. The paper feeder 11 has a pick-up roller 22 that sends out the uppermost one of papers accommodated within a paper tray 21 from left to right in FIG. 1.

A conveyor mechanism that conveys a paper is located at a portion of the paper conveyance path between the paper feeder 11 and the paper discharge tray 12. The conveyor mechanism includes two belt rollers 6, 7, and an endless conveyor belt 8 that are wound on the rollers 6 and 7 so as to span them. An outer circumferential face of the conveyor belt 8, which means a conveyor face 8*a*, is treated with silicone so that it has an adhesive property.

A press roller 5 is disposed immediately downstream of the paper feeder 11 with respect to a paper conveyance direction B, i.e., a direction running from left to right in FIG. 1, at a position opposed to the belt roller 7 across the conveyor belt 8. The press roller 5 presses a paper, which is sent out of the paper feeder 11, onto the conveyor face 8*a* of the conveyor belt 8. In this way, a paper sent out by the pick-up roller 22 is pressed onto the conveyor face 8*a* by means of the press roller 5. Referring to FIG. 1, the paper is, while kept on the conveyor face 8*a* having the adhesive property, conveyed downstream in the paper conveyance direction B along with clockwise rotation (as indicated by the arrow A) of one belt roller 6 rotated by driving of a conveyor motor 131 (see FIG. 8).

A peeling member 13 is disposed immediately downstream of the conveyor mechanism with respect to the paper conveyance direction B, at a position opposed to the belt roller 6 across the conveyor belt 8. The peeling member 13 peels a paper, which is kept on the conveyor face 8*a* of the conveyor belt 8, off the conveyor face 8*a*, and sends the paper to the paper discharge tray 12.

A guide 9 of substantially rectangular-parallelepiped shape is provided within a region enclosed with the conveyor belt 8. The guide 9 supports an inside face of an upper loop of the conveyor belt 8, and is opposed to the ink-jet heads 2 across the conveyor belt 8.

The four ink-jet heads 2 correspond to magenta ink, yellow ink, cyan ink, and black ink, respectively, and are arranged side by side along the paper conveyance direction B. The ink-jet printer 1 is a line-type printer. Each of the ink-jet heads 2 has, at its lower end, a head main body 3 as shown in FIG. 1. The head main body 3 is made up of a passage unit and an actuator layered on each other. Ink passages including nozzles and pressure chambers are formed in the passage unit. The actuator applies pressure to ink contained in the pressure chambers. As shown in FIG. 2, the head main body 3 has a rectangular shape having its longer side extending perpendicularly to the paper conveyance direction B, i.e., to the upward direction in FIG. 2. A lower face of the head main body 3 serves as an ink ejection face 3*a* in which formed are a large number of nozzles each having a small diameter and ejecting ink to a paper. The ink ejection face 3*a* confronts the conveyor face 8*a* of the conveyor belt 8.

The head main bodies 3 are disposed such that the ink ejection faces 3*a* and the conveyor face 8*a* may be in parallel with a narrow clearance formed therebetween. The paper conveyance path runs within this clearance. While a paper conveyed on the conveyor face 8*a* is passing just under the head main bodies 3 of the four heads 2, the nozzles formed in the ink ejection faces 3*a* eject ink of respective colors toward an upper face, i.e., a print face, of the paper, so that a desired color image is formed on the paper.

Figure 2:
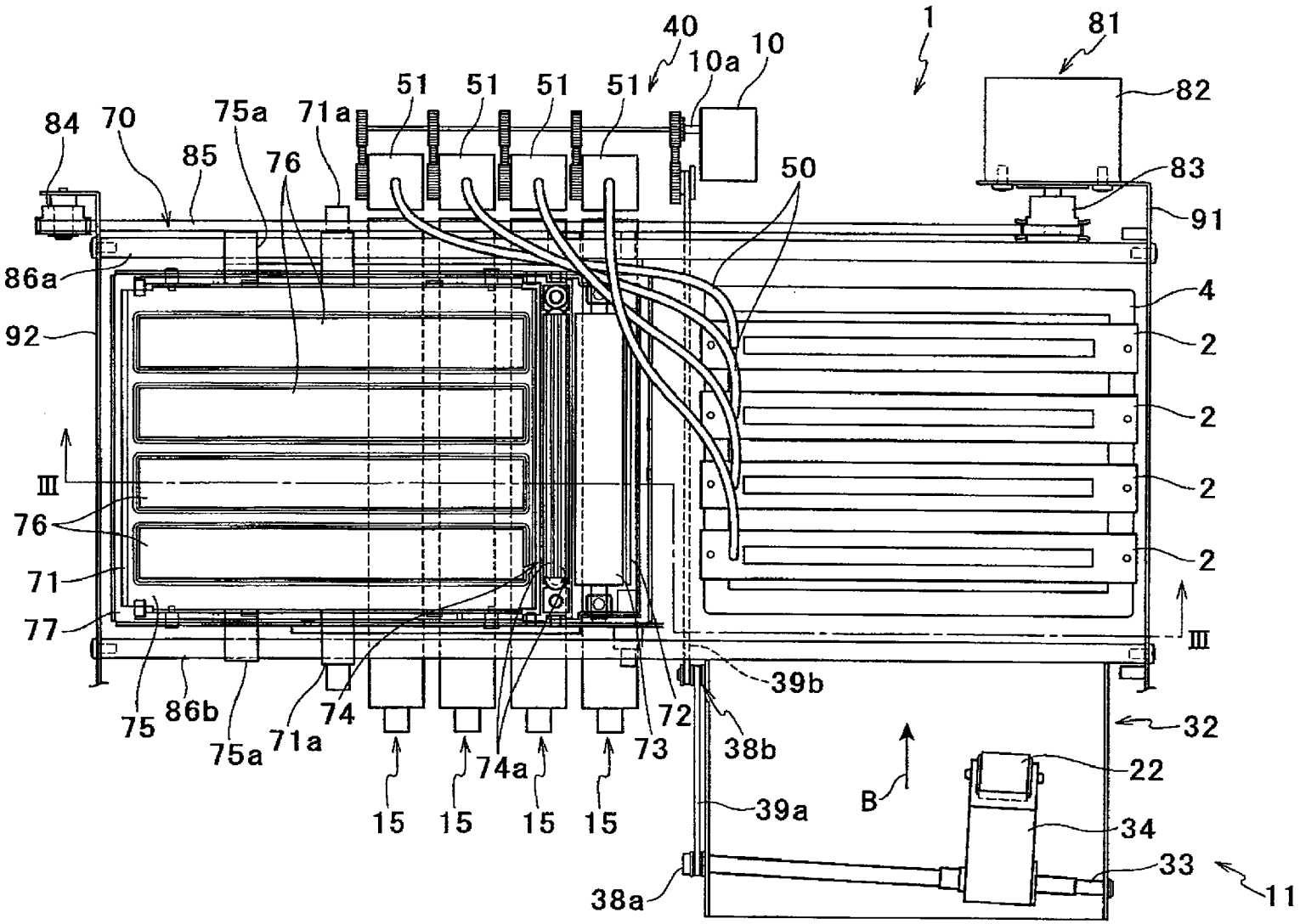
FIG. 2 schematically illustrates a plan view of the ink-jet printer.

As shown in FIG. 2, the four ink-jet heads 2 are, at their longitudinal ends, secured to a frame 4. The frame 4 is held by a frame elevator (not shown), and can be moved up and down. Normally, the frame 4 is placed such that the four ink-jet heads 2 may take a "printing position" (see FIG. 1) whereby they perform printing by ejecting ink to a paper. Only when the ink-jet heads 2 are subjected to a maintenance operation, the frame 4 is placed such that the four ink-jet heads 2 may move from the "printing position" (see FIG. 1) upward into a "maintenance position" (see FIG. 11). In this embodiment, a maintenance operation includes a purge operation for forcibly ejecting from the ink-jet heads 2 through the nozzles, an operation for wiping off ink adhering to the ink ejection faces 3*a*, and an operation for covering the ink ejection faces 3*a* with caps.

Next, with reference to FIGS. 2 and 3, a description will be given to a maintenance unit 70 that performs a maintenance of the ink-jet heads 2.

Figure 3:
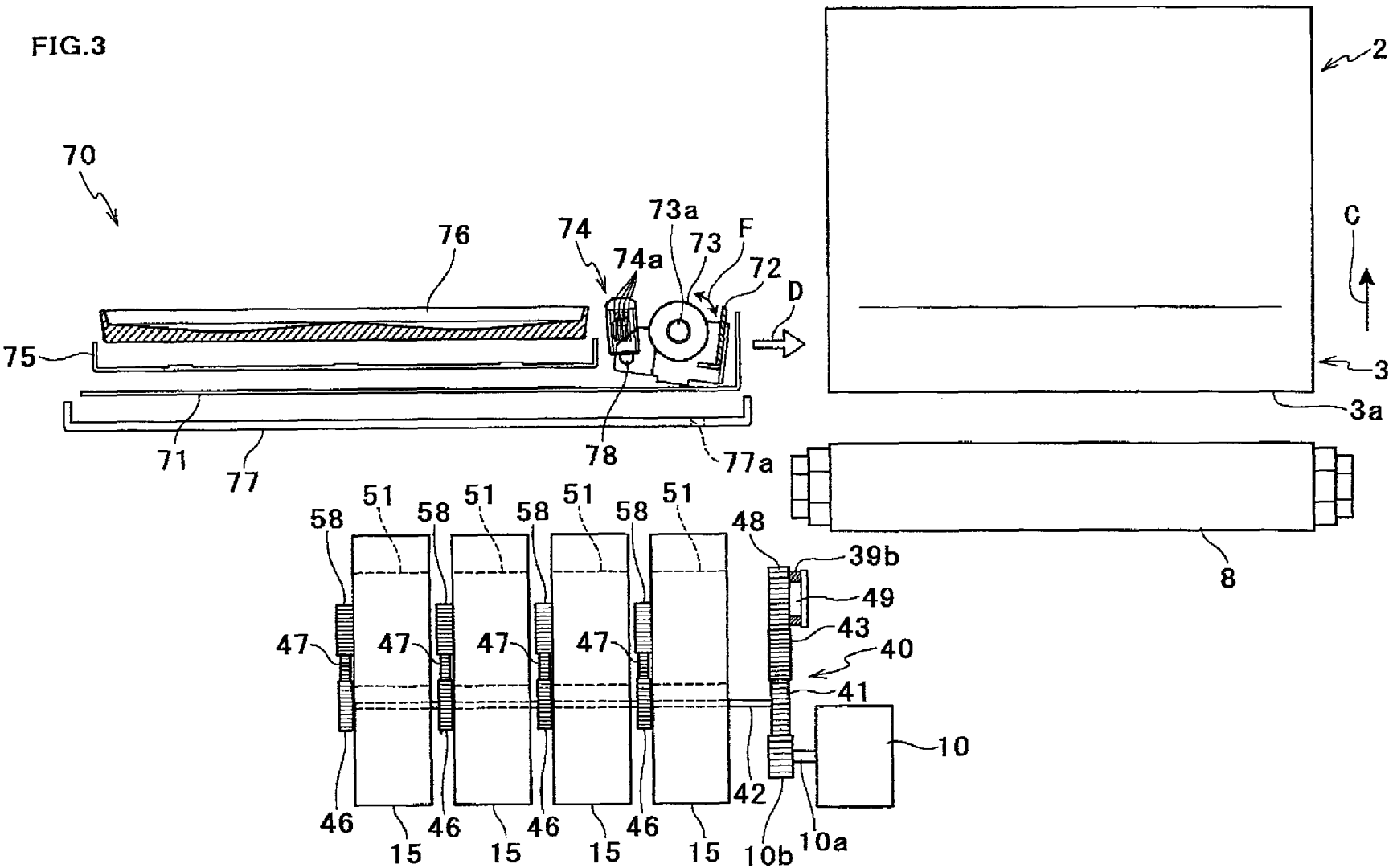
FIG. 3 illustrates a cross-section as taken along a line III-III of FIG. 2.

Except when a maintenance operation is performed on the heads 2, the maintenance unit 70 stays in a "withdrawal position" which locates behind the head main bodies 3 of the four heads 2 in FIG. 1, i.e., which locates on the left side of the head main bodies 3 in FIGS. 2 and 3. When the maintenance unit 70 is in the "withdrawal position", it does not confront the ink-jet heads 2 with respect to the vertical direction. At this time, a waste ink receiver 77 which is fixed to a main body of the printer 1 is disposed just under the maintenance unit 70. The waste ink receiver 77 has, at its end portion near the ink-jet heads 2, an ink outlet 77*a* piercing through its thickness. Through the ink outlet 77*a*, ink flown onto the waste ink receiver 77 is drained into a waste ink reservoir (not shown).

Before the maintenance unit 70 is, as will be described later, moved horizontally in a direction of the arrow D shown in FIG. 3, the frame 4 of the heads are beforehand moved up in a direction of the arrow C shown in FIG. 3, so that the four ink-jet heads 2 are brought into the "maintenance position". As a consequence, a space appears between the four ink-jet heads 2 and the conveyor belt 8 (see FIG. 11), and the maintenance unit 70 can be inserted into this space.

The maintenance unit 70 has a frame 71 that is movable in the horizontal direction. Disposed in the frame 71 are, from the one closest to the ink-jet heads 2, a blade 72, a wipe roller 73, an ink receiving member 74, and a frame 75. Within the frame 75, as shown in FIG. 2, four caps 76 serving to cover the ink ejection faces 3*a* of the respective ink-jet heads 2 are arranged side by side. The caps 76 are made of an elastic material such as rubber, and come into close contact with the ink ejection faces 3*a* of the ink-jet heads 2 so as to cover them.

The ink receiving member 74 includes thin plates 74*a* having a width slightly larger than a width of a whole set of four ink-jet heads 2 that are arranged side by side The thin plates 74*a* are disposed in parallel to each other. The wipe roller 73 has a cylindrical shape, and is rotatably supported on a shaft 73*a* which is parallel to the ink ejection face 3*a*. An axial length of the wipe roller 73 is substantially the same as the width of the thin plate 74*a*. The wipe roller 73 is made of a porous material capable of absorbing ink, such as urethane.

Like the thin plates 74*a* and the wipe roller 73, the blade 72 has a width slightly larger than the width of the whole set of four ink-jet heads 2 that are arranged side by side, and the blade 72 is disposed with its longer side extending in parallel to the paper conveyance direction B. The blade 72 is made of an elastic material such as rubber.

When the maintenance unit 70 is in the "withdrawal position", the members disposed within the frame 71 except the ink receiving member 74, that is, the members 72, 73, and 76 have their upper ends positioned slightly lower than the ink ejection faces 3*a* of the heads 2 in order that they should not come into contact with the ink ejection faces 3*a* during a horizontal movement of the maintenance unit 70 from the "withdrawal position" into the "maintenance position" where they confront the ink ejection faces 3*a*. On the other hand, the ink receiving member 74 is disposed such that a narrow clearance of, e.g. 0.5 mm, may always be formed between the ink ejection faces 3*a* and upper ends of the thin plates 74*a*.

The frame 71 is movable only in the horizontal direction, and fixed with respect to the vertical direction. The members 72, 73, and 76, other than the ink receiving member 74, which are disposed within the frame 71 are movable in the vertical direction with respect to the frame 71. The blade 72 and the wipe roller 73 swing around a shaft 78 in a direction of the arrow F shown in FIG. 3. A cap elevator (not shown) moves the caps 76 up and down within the frame 75. Thereby, distances between the ink ejection faces 3*a* of the heads 2 and the respective members 72, 73, 76 disposed within the frame 71 can appropriately be changed when a maintenance operation is performed as will be described later. While the frame 71 is moving in the horizontal direction, the ink receiving member 74 does not move in the vertical direction with respect to the frame 71, and keeps its "withdrawal position" state in which a narrow clearance of 0.5 mm for example is formed between the ink ejection faces 3*a* and the upper ends of the thin plates 74*a*.

Here, with reference to FIG. 2, a description will be given to a drive mechanism 81 that moves the frame 71 in the horizontal direction. The drive mechanism 81 has a motor 82, a motor pulley 83, an idler pulley 84, a timing belt 85, guide shafts 86*a*, 86*b*, and the like.

The motor 82 is secured to a main-body frame 91 shown on a right side in FIG. 2 with a screw, etc. The motor pulley 83 is connected to the motor 82 so that it is rotated along with driving of the motor 82. The idler pulley 84 is paired with the motor pulley 83, and rotatably supported on a main-body frame 92 on a left side in FIG. 2. The timing belt 85 is wound on the motor pulley 83 and the idler pulley 84 so as to span them, and at the same time connected to one of bearings 71*a* which protrude from opposite side faces of the frame 71. The guide shafts 86*a* and 86*b* extend in parallel with the timing belt 85 so as to span the main-body frames 91 and 92, and are fixed to the main-body frames 91 and 92 with screws, etc. The guide shafts 86*a* and 86*b* support the frames 71 and 75 from their both widthwise sides via the bearings 71*a* and bearings 75*a* that protrude from opposite sides of the frame 75, and the like. The frame 75 has a hook mechanism (not shown) that enables the frame 71 to slide alone or slide together with the frame 75.

Driving the motor 82 causes the motor pulley 83 to rotate in positive or negative direction and thus the timing belt travels. Along with the traveling of the timing belt 85, the frame 71 which is connected to the timing belt 85 via the bearing 71*a* moves rightward or leftward in FIG. 2 into the "maintenance position" or the "withdrawal position".

When the frame 71 and the frame 75 are coupled by the hook mechanism, the frame 75 is moved along with a horizontal movement of the frame 71. That is, the blade 72, the wipe roller 73, the ink receiving member 74 disposed within the frame 71, and the caps 76 disposed within the frame 75 are moved together. When the frame 71 and the frame 75 are not coupled by the hook mechanism, only the blade 72, the wipe roller 73, and the ink receiving member 74 disposed within the frame 71 are moved along with a horizontal movement of the frame 71.

As shown in FIG. 2, the ink-jet heads 2 are connected to respective pumps 51 through flexible tubes 50. These four pumps 51 are arranged in parallel on a left side of a motor 10. As shown in FIG. 3, four ink tanks 15 filled with ink of different colors are provided below the maintenance unit 70. In FIG. 3, each of the ink tanks 15 locates immediately before its corresponding pump 51. Each of the ink tanks 15 is connected to its corresponding pump 51. In this way, an ink supply path extending from an ink tank 15 through a pump 51 and a tube 51 to an ink-jet head 2 is formed for each ink-jet head 2.

The motor 10 is a drive source that drives the four pumps 51 and the pick-up roller 22. As shown in FIG. 3, a driving force transmitter 40 is provided between the motor 10 and the pumps 51. The driving force transmitter 40 transmits rotating force of the motor 10 to the pumps 51 and to the pick-up roller 22. When a drive shaft 10*a* of the motor 10 rotates in the positive direction, i.e., in the clockwise direction or a direction reverse to the arrow shown in FIG. 1, the driving force transmitter 40 transmits rotating force to the pumps 51. When the drive shaft 10*a* of the motor 10 rotates in the negative direction, i.e., in the counterclockwise direction or a direction indicated by the arrow in FIG. 1, the driving force transmitter 40 transmits rotating force to the pick-up roller 22.

Next, the ink supply path will be described with reference to FIG. 4.

Each of the ink-jet heads 2 has, at its one end portion, a connecting member 50*a* through which one end of a tube 50 is connected to the head 2. The other end of the tube 50 is inserted into a discharge outlet 54 of a corresponding pump 51. A hollow needle 52 is disposed in a suction inlet 53 of the pump 51, so that the ink tank 15 and the pump 51 are connected through the hollow needle 52.

Figure 4:
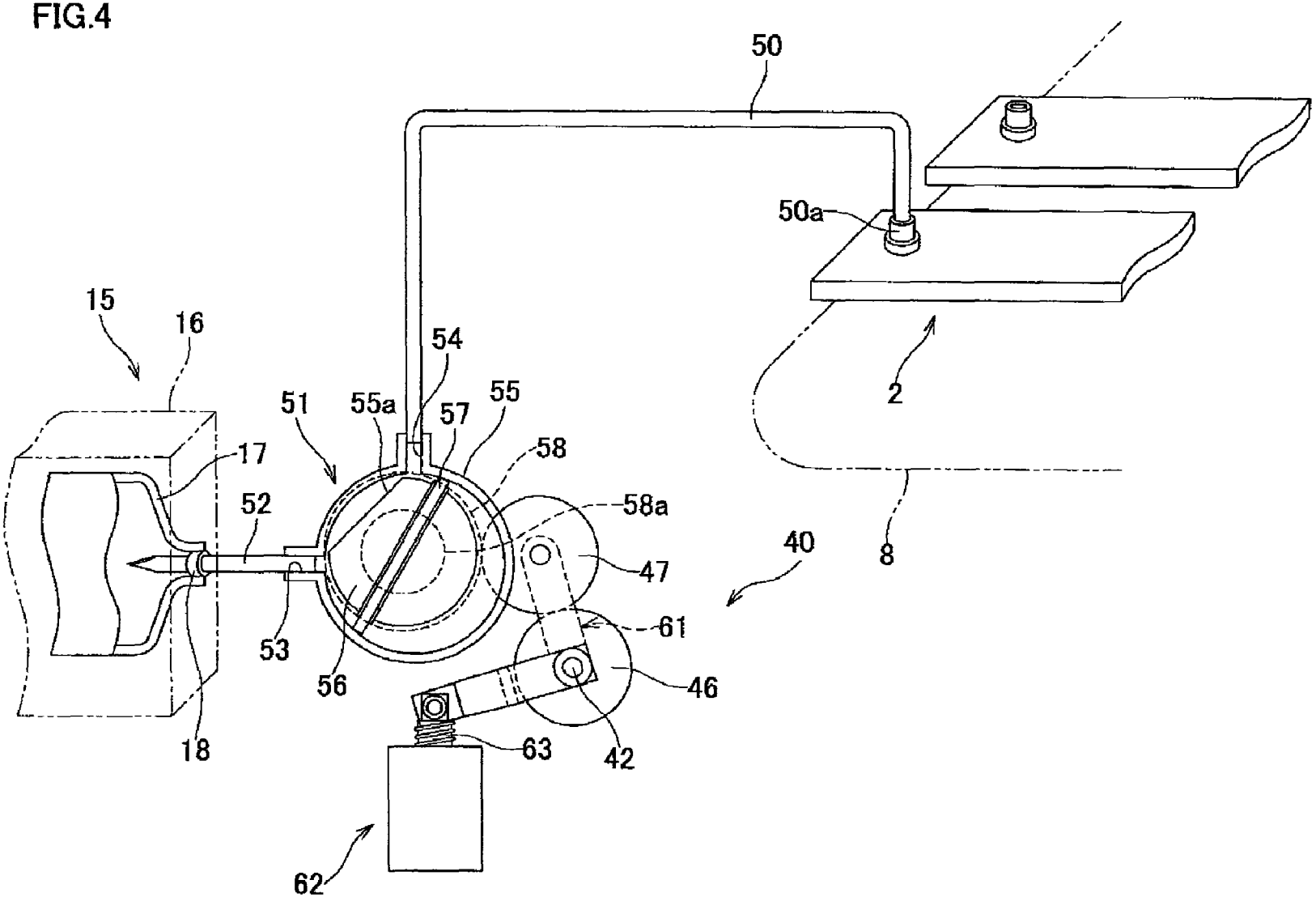
FIG. 4 schematically illustrates an ink supply path of the ink-jet printer.

As shown in FIG. 4, the ink tank 15 has a casing 16 made of a synthetic resin, and an ink bag 17 disposed inside the casing 16. The ink bag 17 contains deaerated ink. The ink bag 17 has a resin-made spout that seals an opening of the ink bag 17. The spout has a cap 18 made of a silicone rubber or a butyl rubber. The ink bag 17 is a pouch pack formed of thermo-compressed, flexible films. The pouch pack has a layered structure made up of an innermost polyethylene layer, a polyester layer acting as a base material, an alumina or silica vapor-deposition layer acting as a gas barrier laid on the polyester layer, and a nylon layer for improving strength of the pack, in this sequence from inside to outside.

The hollow needle 52 of the pump 51 penetrates the cap 18. When ink contained in the ink tank 15 runs out, the hollow needle 52 is pulled out of the cap 18 and then the ink tank 15 can entirely be renewed.

The pump 51 includes a cylinder 55, a rotor 56, and a sliding plate 57. The cylinder 55 of substantially circular shape has the suction inlet 53 and the discharge outlet 54. The rotor 56 of substantially cylindrical shape is rotatably mounted within the cylinder 55 such that a side wall of the rotor 56 may be in contact with an inside face of the cylinder 55 between the suction inlet 53 and the discharge outlet 54. The sliding plate 57 of substantially rectangular shape is slidably attached into a groove that is formed in the rotor 56 so as to pass a center of rotation of the rotor 56. Thus, the sliding plate 57 rotates together with the rotor 56.

The sliding plate 57 is always in contact with the inside face of the cylinder 55, and partitions the interior of the cylinder 55 into two. Since a center of the rotor 56 does not coincide with a center of the cylinder 55, a volume ratio between two sections partitioned by the sliding plate 57 depends on an angle of rotation of the rotor 56.

Referring to FIG. 4, as the rotor 56 rotates counterclockwise, one of the sections formed inside the cylinder 55 and partitioned by the sliding plate 57, which communicates with the suction inlet 53, increases in volume. This causes negative pressure at the suction inlet 53, and therefore ink is sucked out of the ink tank 15 through the suction inlet 53. On the other hand, ink reserved in the other of the sections formed inside the cylinder 55 and partitioned by the sliding plate 57, which communicates with the discharge outlet 54, is pressed and discharged from the discharge outlet 54 through the tube 50 into the ink-jet head 2. The ink is then forcibly ejected through the nozzles of the ink-jet head 2. Thus, the pump 51 works as a so-called rotary pump, and a purge operation for forcibly ejecting ink from the ink-jet head 2 can be implemented by rotationally driving the pump 51.

The rotor 56 has a shape of partially cut-off cylinder. When, in FIG. 4, this cut-off part 55*a* comes to an upper-left portion of the cylinder 55, a path through which the suction inlet 53 and the discharge outlet 54 communicate appears. In a normal state where no purge operation is performed, the rotor 56 is kept in this state in order that ink may be supplied from the ink tank 15 through the pump 51 and the tube 50 into the ink-jet head 2.

Figure 5A:
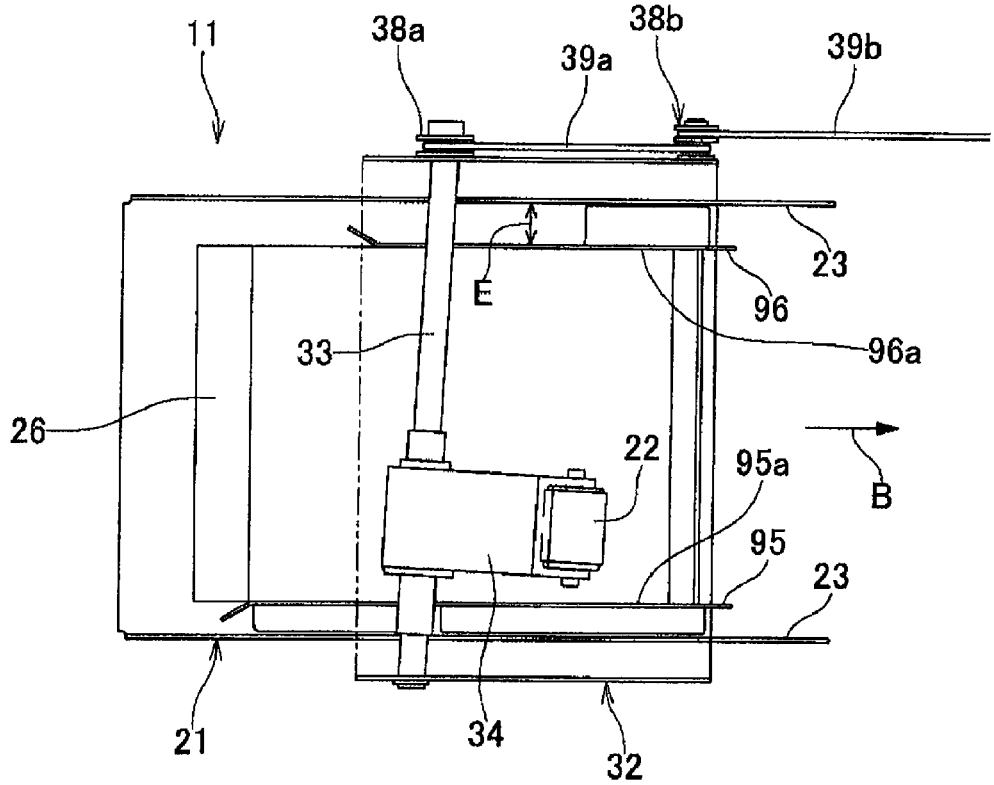
FIG. 5A schematically illustrates a plan view of a paper feeder that is provided in the ink-jet printer.
Figure 5B:
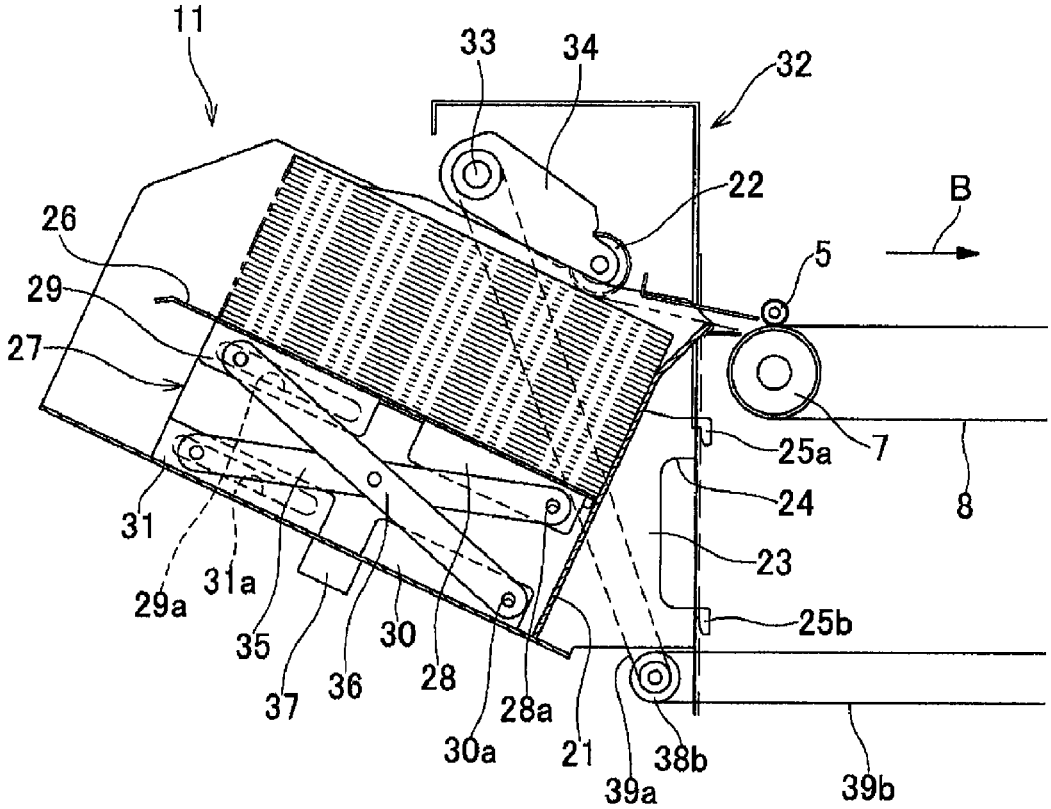
FIG. 5B illustrates a cross-section of the paper feeder that is provided in the ink-jet printer.

Next, the paper feeder 11 will be described with reference to FIGS. 5A and 5B.

The paper feeder 11 includes the paper tray 21 in which papers are stacked. As shown in FIG. 5A, the paper tray 21 has two connecting portions 23 that extend out along the paper conveyance direction B and are connected to the main body of the printer 1. As shown in FIG. 5B, a recess-like notch 24 is formed substantially in the middle of an end of the connecting portion 23 near the main body of the printer 1. Hooked supporting members 25*a* and 25*b* are formed above and below the notch 24. The paper feeder 11 including the paper tray 21 is fixed to the main body of the printer 1 by engagement of the supporting members 25*a* and 25*b* with engagement grooves (not shown) that are formed in the main body of the printer 1.

The connecting portions 23 are formed in such a manner that the paper tray 21 may incline while it is fixed to the main body of the printer 1. This makes it easy for the pick-up roller 22 to send out a paper toward the paper conveyance direction B. In addition, since the paper tray 21 opens in its upper side and upstream side with respect to the paper conveyance direction B, a paper can easily be accommodated into the paper tray 21.

A supporter 26 and an elevator 27 are mounted within the paper tray 21. The supporter 26 supports stacked papers from a bottom side thereof. With respect to the paper conveyance direction B, a downstream end of a stack of papers supported on the supporter 26 is in contact with a side plate of the paper tray 21. The elevator 27 locates below the supporter 26, and serves to move the supporter 26 up and down in a paper stacking direction.

The elevator 27 includes flanges 28 and 29, flanges 30 and 31, and link members 35 and 36. The flanges 28 and 29 extend downward from a lower face of the supporter 26. The flanges 30 and 31 extend upward from a bottom plate of the paper tray 21 such that they may be opposed to the flanges 28 and 29, respectively. The link members 35 and 36 are rotatably linked to the flanges 28 to 31.

The flanges 28 to 31 have through holes 28*a* to 31*a*, respectively, and they are linked to the link members 35 and 36 through the through holes 28*a* to 31*a*. The through holes 29*a* and 31*a* of the flanges 29 and 31, which are upstream ones with respect to the paper conveyance direction B, are shaped into slots elongated in a direction perpendicular to the paper stacking direction. The link members 35 and 36 have, at their both ends, shafts for being inserted into the through holes 28*a* to 31*a*. Via these shafts, the link member 35 is linked to the flanges 28 and 31, and the link member 36 is linked to the flanges 29 and 30. The link member 35 and the link member 36 are linked substantially at their centers.

A motor 37 which is a drive source for moving the supporter 26 up and down is provided on a lower face of the bottom plate of the paper tray 21. The motor 37 is connected to a not-shown mechanism that moves, toward upstream and downstream with respect to the paper conveyance direction B, the shaft of the link member 35 used for connecting to the flange 31. When the motor 37 is driven so that the shaft of the link member 35 used for connecting to the flange 31 is moved along the through hole 31*a* toward upstream and downstream with respect to the paper conveyance direction B, the supporter 26 is moved up and down in the paper stacking direction by means of the link mechanism made up of the flanges 28 to 31 and the connecting members 35, 36.

Normally, the supporter 26 takes such a position that the uppermost one of the papers stacked on the supporter 26 may be in contact with the pick-up roller 22. However, prior to driving the pump 51 as will be described later, the supporter 26 is moved down such that the uppermost one of the papers stacked on the supporter 26 may not be in contact with the pick-up roller 22 but may be away from the pick-up roller 22.

The paper tray 21 has a fixed guide 95 and a movable guide 96. The fixed guide 95 and the movable guide 96 extend along the paper conveyance direction B. The fixed guide 95 and the movable guide 96 are respectively in contact with opposite sides, along the paper conveyance direction B, of a set of papers stacked on the supporter 26. The movable guide 96 can be slid in a widthwise direction of the paper (as indicated by the arrow E in FIG. 5A). Both sides of the papers can be aligned by sliding the movable guide 96 to bring its guide face 96*a* into contact with the other side of the papers while keeping the one side of the papers in contact with a guide face 95*a* of the fixed guide 95 to thereby sandwich the papers between the guide faces 95*a* and 96*a* of the guides 95 and 96.

A bracket 32 extending from a side face of the main body of the printer 1 toward the paper tray 21 is provided. As shown in FIG. 5A, the bracket 32 supports both ends of a shaft 33 in a rotatable manner. An arm 34 is mounted on the shaft 33. The arm 34 supports the pick-up roller 22, and has a not-shown mechanism for transmitting rotating force of the shaft 33 to the pick-up roller 22.

A belt roller 38*a* is fixed to one end, i.e., the upper end in FIG. 5A, of the shaft 33, and a belt roller 38*b* is disposed below the connecting portion 23 of the paper tray 21 (see FIG. 5B). A power transmission belt 39*a* spans the belt rollers 38*a* and 38*b*. When the belt roller 38*b* rotates, the power transmission belt 39*a* travels, and the belt roller 38*a* rotates along with the traveling of the power transmission belt 39*a*.

As shown in FIG. 1, the belt roller 38*b* is also connected through a power transmission belt 39*b* to a belt roller 49 disposed at a position obliquely downward from the belt roller 6. The belt roller 49 is coaxially fixed to a gear 48 which is coupled with a gear 10*b* of the motor 10 through the driving force transmitter 40.

The belt roller 38*b* has two rollers having different diameters and fixed coaxially to each other. Small-diameter one of the two rollers is wound with the power transmission belt 39*a*, and large-diameter one is wound with the power transmission belt 39*b*.

When the drive shaft 10*a* of the motor 10 rotates in the negative direction, i.e., in the counterclockwise direction or a direction of the arrow in FIG. 1, rotating force of the motor 10 is transmitted to the gear 48 of the driving force transmitter 40. Then, the belt roller 49 rotates along with the gear 48, so that the power transmission belt 39*b* travels. The belt roller 38*b* rotates along with the traveling of the power transmission belt 39*b*. The rotation of the belt roller 38*b* causes the power transmission belt 39*a* to travel, thus rotating the belt roller 38*a* together with the shaft 33 (see FIG. 5A). Rotating force of the shaft 33 is transmitted through the arm 34 to the pick-up roller 22 which is thereby rotated. Accordingly, the uppermost one of the papers stacked on the supporter 26 of the paper tray 21, which is in contact with the pick-up roller 22, is sent out onto the conveyor belt 8 by means of the rotation of the pick-up roller 22.

Next, the driving force transmitter 40 will be described.

As shown in FIGS. 1, 3, 6A, and 6B, the driving force transmitter 40 includes a sun gear 41, a shaft 42, and a planet gear 43. The sun gear 41 is engaged with the gear 10*b* of the motor 10. The shaft 42 is fixed to the sun gear 41 so that it may rotate with the sun gear 41. The planet gear 43 is engaged with the sun gear 41. Attached to the shaft 42 is a holder 44 that holds the planet gear 43 such that the planet gear 43 may be able to revolve around the sun gear 41. The holder 44 includes a connecting portion 44*a* and a supporting portion 44*b*. The connecting portion 44*a* connects the shaft 42 to a shaft 43*a* of the planet gear 43. The supporting portion 44*b* is substantially U-shaped across the sun gear 41, and one end of the supporting portion 44*b* is rotatably connected to the shaft 42. The connecting portion 44*a* and the supporting portion 44*b* are formed in one piece.

Figure 6A:
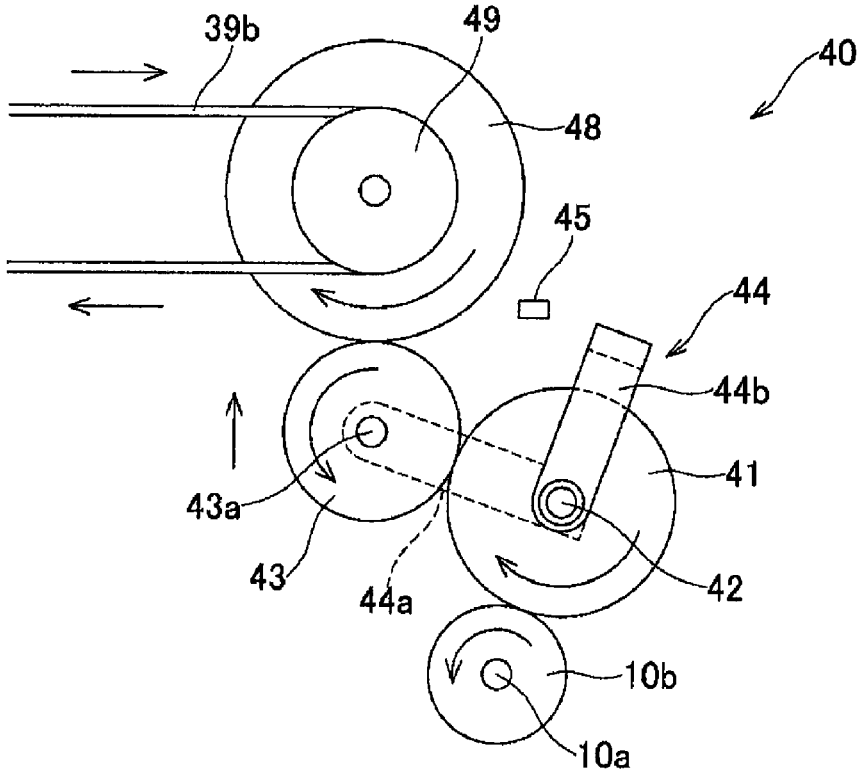
FIG. 6A illustrates a region of FIG. 1 enclosed with an alternate long and short dash line, and shows an operating condition of a motor which is rotating in a negative direction.
Figure 6B:
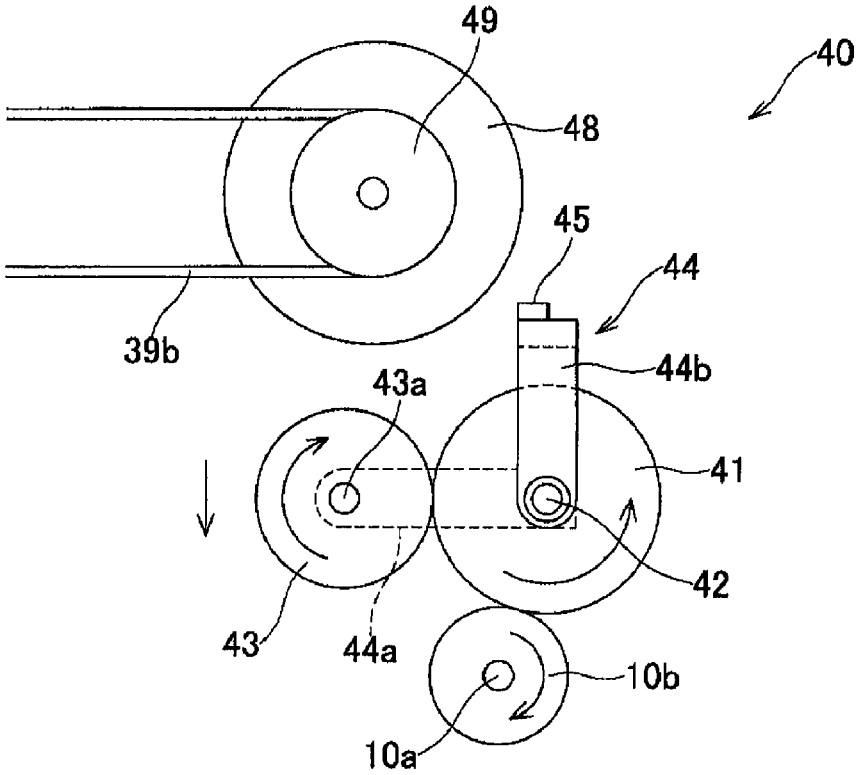
FIG. 6B illustrates the region of FIG. 1 enclosed with the alternate long and short dash line, and shows an operating condition of the motor which is rotating in a positive direction.

If, in a state where the planet gear 43 is in contact with the gear 48 as shown in FIG. 6A, the holder 44 rotates on the shaft 42 in the counterclockwise direction in FIG. 6A, the other end of the supporting portion 44*b* comes into contact with an abutment 45 which is fixed to the main body of the printer, as shown in FIG. 6B. Therefore, the holder 44 cannot rotate counterclockwise any longer. That is, a range in which the holder 44 and the planet gear 43 held on the holder 44 can swing around the shaft 42 is between a point where the planet gear 43 and the gear 48 are in contact with each other as shown in FIG. 6A and a point where the other end of the supporting portion 44*b* comes into contact with the abutment 45 as shown in FIG. 6B. Since the planet gear 43 does not revolve counterclockwise beyond the point shown in FIG. 6B, the planet gear 43 and the gear 10*b* are not brought into contact and therefore one or both of them is/are not damaged.

Here, a description will be given to how the planet gear 43 swings depending on a rotation direction of the motor 10.

Referring to FIG. 6A, when the drive shaft 10*a* and the gear 10*b* of the motor 10 rotate in the negative direction, i.e., in the counterclockwise direction or a direction indicated by the arrow, the sun gear 41 engaged with the gear 10*b* rotates clockwise, and the planet gear 43 engaged with the sun gear 41 rotates counterclockwise. At this time, the clockwise rotating force of the sun gear 41 moves the planet gear 43 up into engagement with the gear 48. When the planet gear 43 is brought into engagement with the gear 48, rotating force of the planet gear 43 is transmitted to the gear 48, so that the gear 48 and the belt roller 49 rotate clockwise in FIG. 6A. As the belt roller 49 rotates, the power transmission belt 39*b* wound on the belt roller 49 travels.

That is, if the motor 10 rotates in the negative direction, the rotating force of the motor 10 is transmitted to the gear 48. Consequently, as described above, the uppermost one of the papers stacked on the supporter 26 of the paper tray 21, which is in contact with the pick-up roller 22, is sent out onto the conveyor belt 8 by means of the rotation of the pick-up roller 22.

Referring to FIG. 6B, when the drive shaft 10*a* and the gear 10*b* of the motor 10 rotate in the positive direction, i.e., in the clockwise direction or a direction indicated by the arrow, the sun gear 41 engaged with the gear 10*b* rotates counterclockwise, and the planet gear 43 engaged with the sun gear 41 rotates clockwise. At this time, the counterclockwise rotating force of the sun gear 41 moves the planet gear 43 down away from the gear 48.

That is, if the motor 10 rotates in the positive direction, the rotating force of the motor 10 is not transmitted to the gear 48 and therefore the pick-up roller 22 does not rotate. On the other hand, gears 46 and planet gears 47, which will be described later, rotate along with the positive rotation of the motor 10, so that the rotating force of the motor 10 can be transmitted to the pumps 51 in accordance with expansion and contraction of a shaft 63 of a solenoid 62.

Like this, in accordance with a rotation direction of the motor 10, the driving force transmitter 40 can change a target to which the rotating force of the motor 10 is transmitted. That is, when the motor 10 rotates in the positive direction the rotating force of the motor 10 is transmitted to the pumps 51, and the motor 10 rotates in the negative direction the rotating force of the motor 10 is transmitted to the pick-up roller 22.

Further, as shown in FIGS. 3 and 4, the driving force transmitter 40 includes four sun gears 46 disposed in series along a direction of extension of the shaft 42, and four planet gears 47 respectively engaged with the sun gears 46. The sun gears 46 are respectively disposed near the corresponding pumps 51, and fixed to the shaft 42 such that that they may rotate with the shaft 42.

Figure 7A:
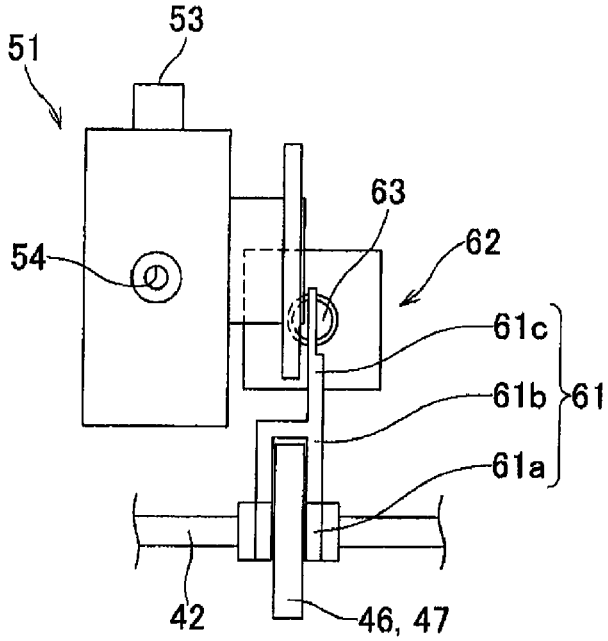
FIG. 7A schematically illustrates a plan view around a pump that is provided in the ink-jet printer.
Figure 7B:
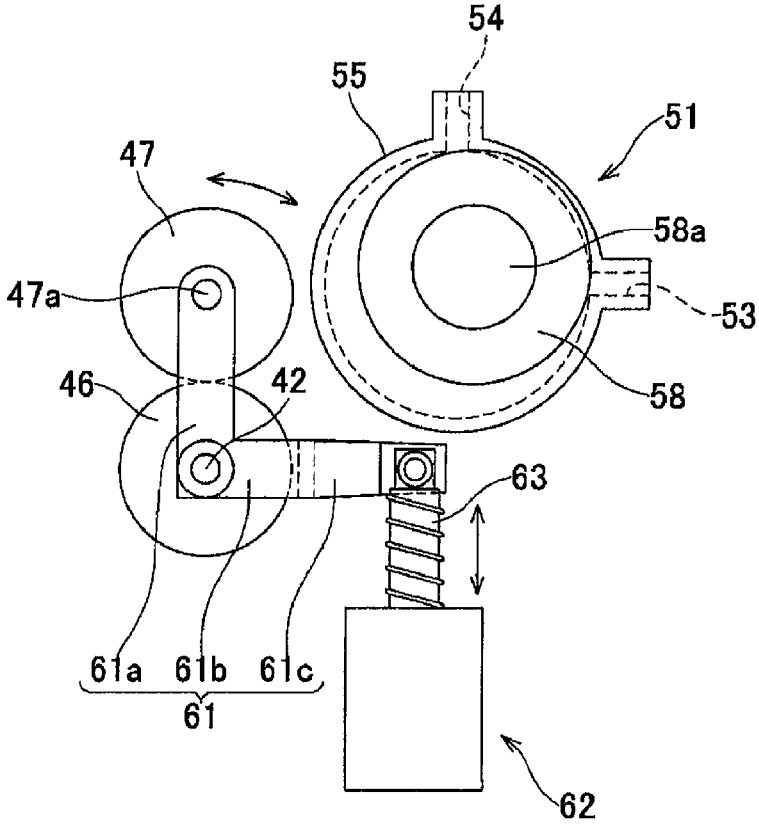
FIG. 7B illustrates a side view around the pump that is provided in the ink-jet printer.

Mounted to the shaft 42 are four holders 61 (only one of which is shown in FIG. 4) that hold the respective planet gears 47 such that the planet gears 47 may revolve around the corresponding sun gears 46. As shown in FIGS. 7A and 7B, the holder 61 includes a connecting portion 61*a*, a supporting portion 61*b*, and an extending portion 61*c*. The connecting portion 61*a* connects the shaft 42 to a shaft 47*a* of the planet gear 47. The supporting portion 61*b* is substantially U-shaped across the sun gear 46, and one end of the supporting portion 61*b* is rotatably connected to the shaft 42. The extending portion 61*c* extends out from the other end of the supporting portion 61*b*, and is connected to a shaft 63 of a solenoid 62. The connecting portion 61*a* and the supporting portion 61*b* are formed in one piece.

The holder 61 and the planet gear 47 held on the holder 61 can swing around the shaft 42 in accordance with expansion and contraction of the shaft 63. A range of the swinging is defined in accordance with the amount of the expansion and contraction. To be more specific, when the shaft 63 of the solenoid 62 is in an expansion mode as shown in FIG. 7B, the planet gear 47 takes a position spaced away from a gear 58 of the pump 51. When the shaft 63 of the solenoid 62 is in a contraction mode as shown in FIG. 4, the planet gear 47 is engaged with the gear 58 of the pump 51. A drive shaft 58*a* of the gear 58 is mounted at the center of rotation of the rotor 56. The rotor 56 rotates along with rotation of the gear 58 and the drive shaft 58*a*.

A set of a sun gear 46, a planet gear 47, a holder 61, and a solenoid 62 is provided for each pump 51.

When the drive shaft 10*a* and the gear 10*b* of the motor 10 rotates in the positive direction, the planet gear 43 is spaced away from the gear 48 and the sun gear 41 rotates counterclockwise as indicated by the arrow in FIG. 6B. If, in this state, the shaft 63 of the solenoid 62 is contracted as shown in FIG. 4, the planet gear 47 is brought into engagement with the gear 58 of the pump 51 to thereby transmit rotating force of the motor 10 to the gear 58 of the pump 51. Thus, along with the rotation of the gear 58, the rotor 56 which is fixed to the gear 58 through the drive shaft 58*a* rotates and ink contained in the pump 51 is fed to the ink-jet head 2 as described above. Thereby, a purge operation for forcibly ejecting ink from the ink-jet head 2 can be implemented.

As described above, a set of a sun gear 46, a planet gear 47, a holder 61, and a solenoid 62 is provided for each pump 51. Therefore, it is possible to selectively drive a pump 51 corresponding to an ink-jet head 2 which should be subjected to a purge operation.

Alternatively, if the four pumps 51 are driven all at once, a purge operation can be performed simultaneously on the four ink-jet heads 2. In this case, as compared with a purge operation performed individually on each ink-jet head 2, a shorter time is needed in the purge operation.

The holder 61 is connected to the solenoid 62. Therefore, even while the motor 10 is stopping its rotation, the holder 61 swings in accordance with expansion and contraction of the shaft 63 of the solenoid 62, to move the planet gear 47 into engagement with the gear 58 or away from the gear 58.

Figure 8:
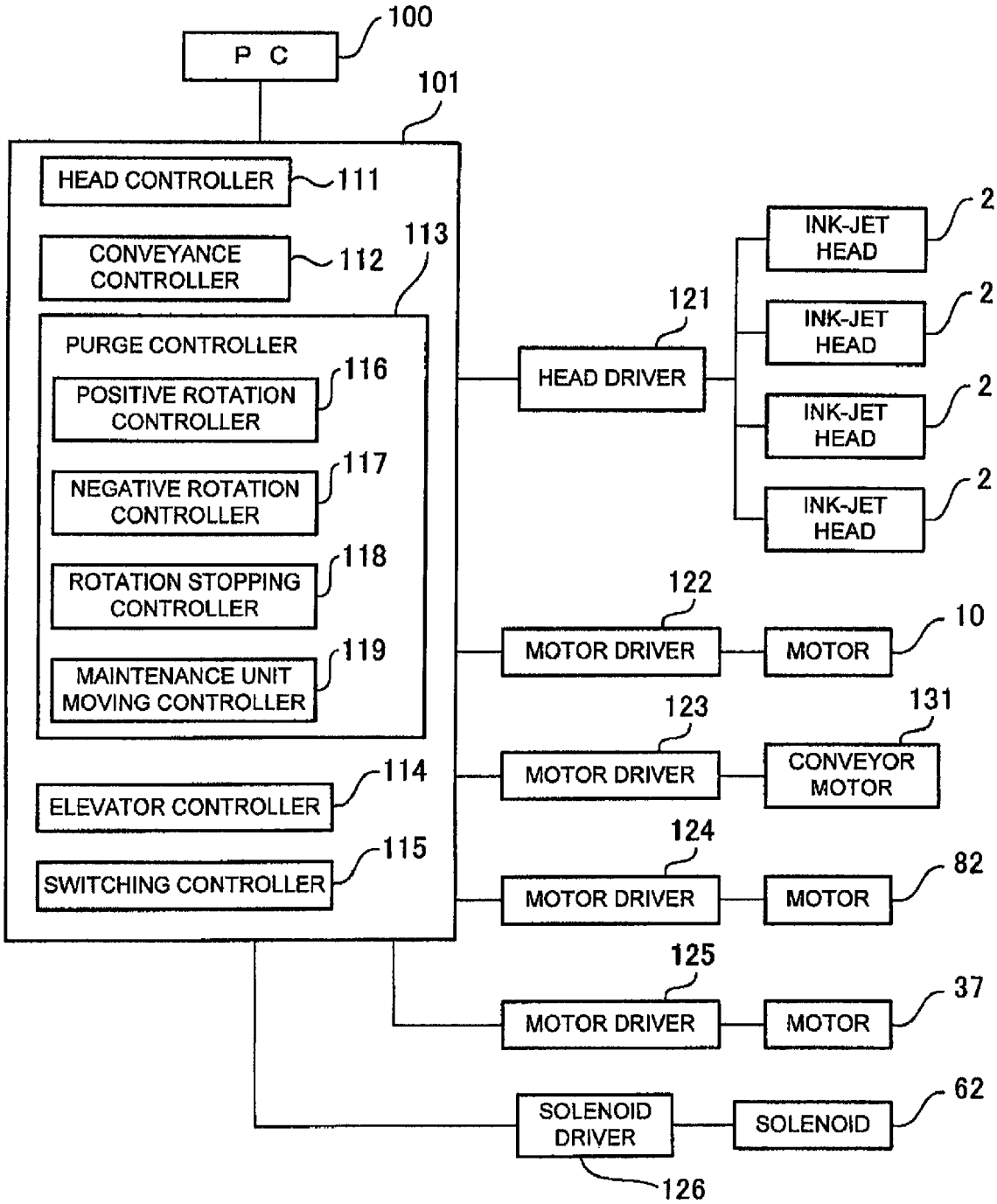
FIG. 8 is a block diagram showing a control unit of the ink-jet printer.

Next, a control unit 101 of the ink-jet printer 1 will be described with reference to FIG. 8.

The control unit 101 has a CPU (Central Processing Unit) that is an arithmetic processing unit, a ROM (Read Only Memory) that stores a control program executed by the CPU and data used for the control program, and a RAM (Random Access Memory) that temporarily stores data during execution of a program. The control unit 101 includes a head controller 111, a conveyance controller 112, a purge controller 113, an elevator controller 114, and a switching controller 115.

When the control unit 101 receives print data from a PC (Personal Computer) 100, the head controller 111 controls a head drive circuit 121 to eject ink from an appropriate ink-jet head 2.

When the control unit 101 receives print data from the PC 100, the conveyance controller 112 controls a motor driver 122 so as to rotate the drive shaft 10*a* of the motor 10 in the negative direction, and at the same time controls a motor driver 123 so as to drive the conveyor motor 131 thus conveying a paper on the conveyor belt 8.

The purge controller 113 includes a positive rotation controller 116, a negative rotation controller 117, a rotation stopping controller 118, and a maintenance unit moving controller 119. When the control unit 101 receives a purge signal outputted upon a later-described initial operation, which is performed when powering up the printer, exchanging the ink tank 15, etc., or a purge signal outputted from the PC 100, the positive rotation controller 116 drives the motor driver 122 so as to rotate the drive shaft 10*a* of the motor 10 in the positive direction. After a later-described switching controller 115 controls a solenoid driver 126 and before the positive rotation controller 116 controls the motor driver 122, the negative rotation controller 117 controls the motor driver 122 so as to rotate the drive shaft 10*a* of the motor 10 slightly in the negative direction. Just before the negative rotation controller 117 rotationally drives the drive shaft 10*a* of the motor 10, the rotation stopping controller 118 controls the motor driver 122 so as to stop rotation of the drive shaft 10*a* of the motor 10. The maintenance unit moving controller 119 controls a motor driver 124 so as to drive the motor 82 in order to horizontally move the frames 71 and 75 or the frame 71 alone of the maintenance unit 70 into the "maintenance position" or the "withdrawal position". In addition, when a purge signal outputted upon a later-described initial operation or a purge signal outputted from the PC 100 is received, the purge controller 113 controls a driver (not shown) such that the frame elevator (not shown) may move the four ink-jet heads 2 into the "maintenance position".

When the control unit 101 receives print data from the PC 100 or after a purge operation on the ink-jet heads 2 completes, the elevator controller 114 controls a motor driver 125 so as to drive the motor 37 such that the uppermost one of the papers stacked in the paper tray 21 may come into contact with the pick-up roller 22. In addition, when the control unit 101 receives a purge signal outputted upon a later-described initial operation or a purge signal outputted from the PC 100, the elevator controller 114 controls the motor driver 125 so as to drive the motor 37 such that the uppermost one of the papers stacked in the paper tray 21 may be away from the pick-up roller 22.

When the control unit 101 receives a purge signal outputted upon a later-described initial operation or a purge signal outputted from the PC 100, the switching controller 115 controls a solenoid driver 126 so as to expand or contract the shaft 63 of the solenoid 62.

Figure 9:
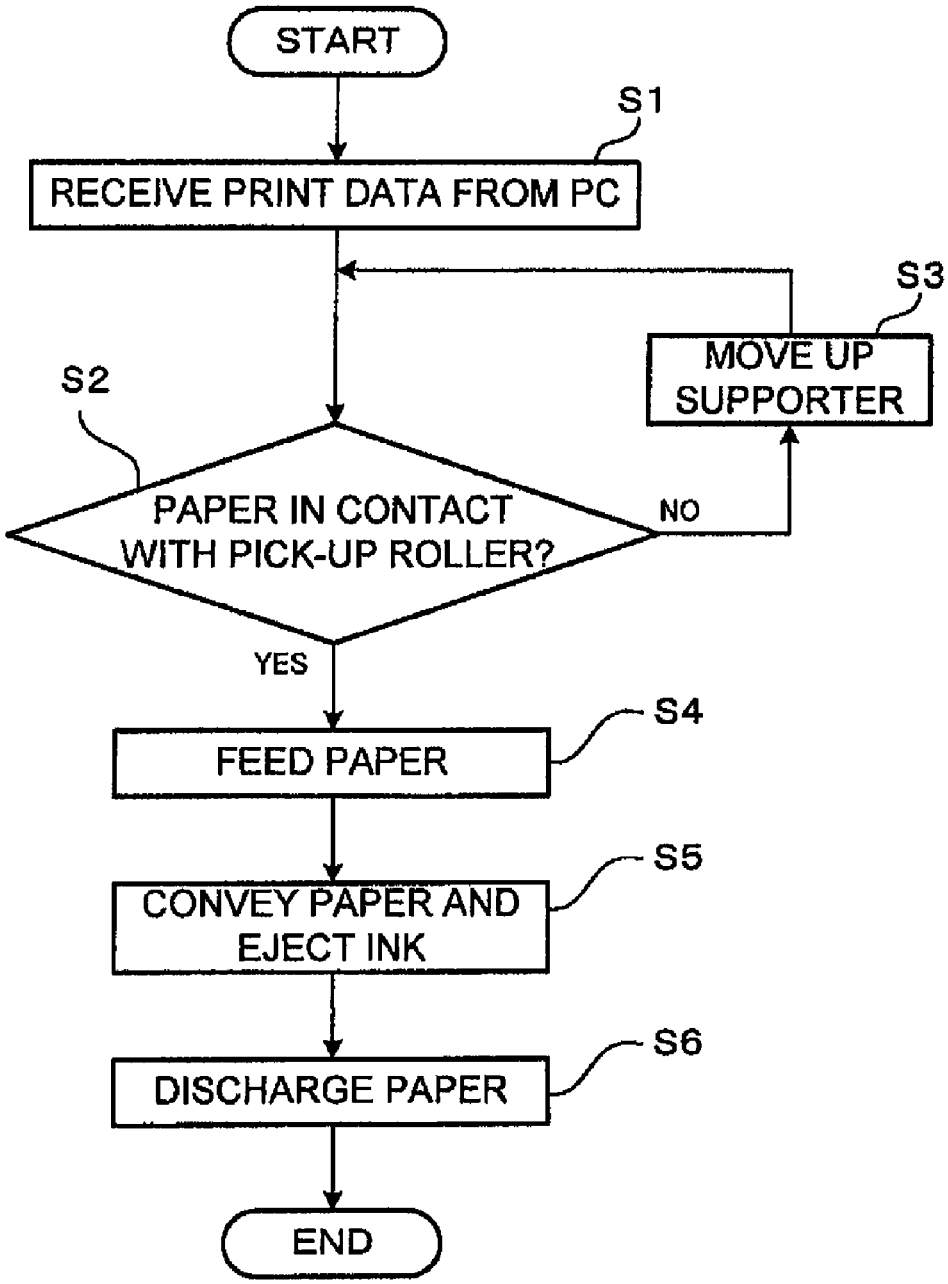
FIG. 9 is a flowchart showing a flow of control of the ink-jet printer in a printing operation.

Next, a flow of control in a printing operation will be described with reference to FIG. 9.

In order to record an image on a paper using the ink-jet printer 1, first, the control unit 101 receives print data from the PC 100 (S1). The control unit 101 then determines whether the pick-up roller 22 is in contact with the uppermost one of the papers stacked in the paper tray 21 (S2).

If the uppermost paper is not in contact with but away from the pick-up roller 22 (S2: NO), the elevator controller 114 controls the motor driver 125 so as to drive the motor 37, so that the supporter 26 is moved up (S3) to bring the paper into contact with the pick-up roller 22.

If the uppermost paper is in contact with the pick-up roller 22 (S2: YES), this paper is fed onto the conveyor belt 8 (S4). To be more specific, the conveyance controller 112 controls the motor driver 122 so as to rotate the drive shaft 10*a* of the motor 10 in the negative direction, so that the pick-up roller rotates to send the uppermost paper onto the conveyor belt 8.

After S4, the paper is conveyed on the conveyor belt 8 and at the same time the ink-jet heads 2 eject ink (S5) More specifically, the conveyance controller 112 drives the motor driver 123 so as to drive the conveyance motor 131, so that the belt roller 6 is rotated to convey the paper disposed on the conveyor belt 8 toward the paper discharge tray 12. At the same time, the head controller 111 drives the ink-jet heads 2 through the head drive circuit 121, so that ink is ejected onto the paper. Then, the paper thus printed is delivered to the paper discharge tray 12 (S6).

Next, with reference to FIGS. 10 to 13, a description will be given to a purge operation which is performed when the ink-jet printer 1 is initially operated, when the ink-jet head 2 incurs defectiveness in ejection.

Figure 10:
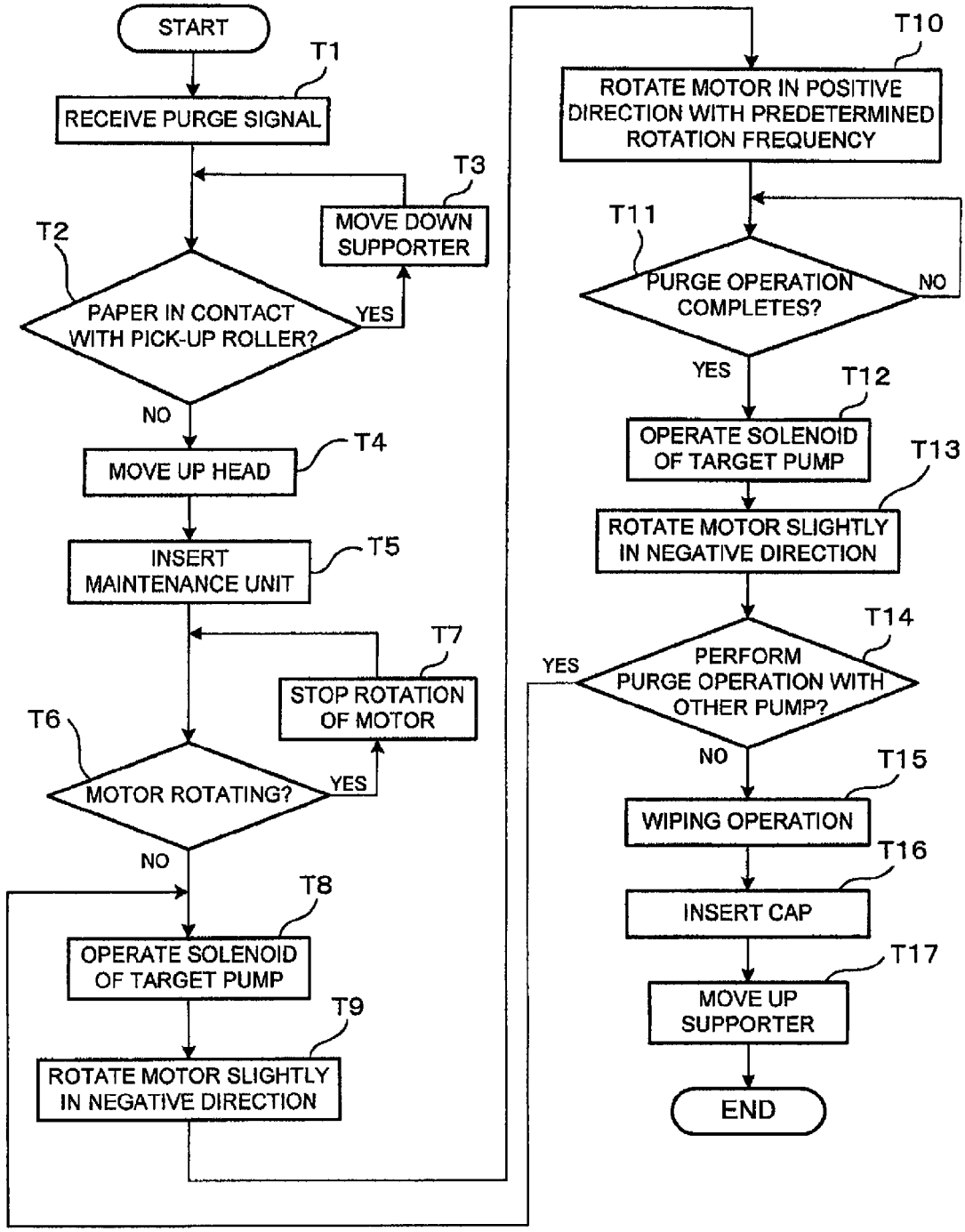
FIG. 10 is a flowchart showing a flow of control of the ink-jet printer in a purge operation.

In order to perform a purge operation on the ink-jet head 2, first, the control unit 101 receives a purge signal as shown in FIG. 10 (T1). The purge signal includes a pump selection command that instructs which one(s) of the four pumps 51 respectively corresponding to the four ink tanks 15 should be subjected to a purge operation.

The ink-jet printer 1 is configured such that the ink-jet printer 1 itself may forcibly shift into a purge operation in an initial operation which is performed when powering up the printer, exchanging the ink tank 15, etc. Therefore, the control unit 101 receives a purge signal from the ink-jet printer 1 itself. When the printer is turned ON, there is received a purge signal including a command commanding that all the four pumps 51 should perform a purge. When the ink tank 15 is renewed, there is received a purge signal including a command commanding that a pump 51 corresponding to the renewed ink tank 15 should perform a purge. When, after powered up, the printer shifts from a normal use mode to a purge operation, the control unit 101 receives a purge signal from the PC 100.

After T1, the control unit 101 determines whether the pick-up roller 22 is in contact with the uppermost one of the papers stacked in the paper tray 21 (T2). If the uppermost paper is in contact with the pick-up roller 22 (T2: YES), the elevator controller 114 controls the motor driver 125 so as to drive the motor 37, so that the supporter 26 is moved down (T3) to bring the paper out of contact with the pick-up roller 22.

If the uppermost paper is not in contact with but away from the pick-up roller 22 (T2: NO), the four ink-jet heads 2 are moved up (T4). More specifically, the purge controller 113 drives the driver (not shown) so as to move up, through the frame elevator (not shown), the four ink-jet heads 2 fixed to the frame 4 from the "printing position" (see FIG. 1) to the "maintenance position" (see FIG. 11).

After T4, the maintenance unit 70 is inserted into a space between the four ink-jet heads 2 and the conveyor belt 8 (T5). More specifically, the maintenance unit moving controller 119 controls the motor driver 124 so as to drive the motor 82, in order that the maintenance unit 70, except the frame 75 and the caps 76 disposed within the frame 75, is moved horizontally in a direction of the arrow D shown in FIG. 11 and positioned such that a region of the frame 71 previously opposed to the frame 75 may be opposed to the ink ejection faces 3*a*. At this time, the frame 75 is not coupled with the frame 71 by the hook mechanism, and therefore the frame 71 alone is moved while the frame 75 and the caps 76 of the frame 75 are not moved but kept in the position where they locate in FIG. 11.

After T5, the purge controller 113 determines whether the motor 10 is rotating or not (T6). If the motor 10 is rotating (T6: YES), the rotation stopping controller 118 stops, through the motor driver 122, the rotation of the drive shaft 10*a* of the motor 10 (T7). In this way, the drive shaft 10*a* of the motor 10 stops rotating, and accordingly the planet gear 47 (see FIG. 4) stops rotating, too. Like this, the planet gear 47 whose rotation is stopped is moved into engagement with the gear 58. This can prevent damage which may otherwise be caused by the rotating planet gear 47 coming into contact with the gear 58.

If the motor 10 is not rotating (T6: NO), the solenoid 62 corresponding to the pump 51 which should be subjected to a purge operation is activated (T8). More specifically, the switching controller 115 controls the solenoid driver 126 so as to contract the shaft 63 of the solenoid 62 corresponding to the pump 51 which should be subjected to a purge operation, so that the planet gear 47 is brought into contact with the gear 58 (see FIG. 4). Such a control by means of the switching controller 115 enables the pumps 51 to be driven.

After T8, the motor 10 is rotated slightly in the negative direction (T9). More specifically, the negative rotation controller 117 controls the motor driver 122 so as to rotate the drive shaft 10*a* of the motor 10 slightly in the negative direction. As a result, the planet gear 47 and the gear 58 can surely be engaged with each other. That is, even if the planet gear 47 and the gear 58 are excessively engaged with each other with their teeth being in contact, the excessive engagement between the teeth of the gear 47 and the teeth of the gear 58 can be eased by rotating the shaft 10*a* of the motor 10 in the negative direction in T9. Thus, the teeth make good engagement so that both of the gears 47 and 58 can rotate.

After T9, the positive rotation controller 116 controls the motor 10 through the motor driver 122, so as to rotate the motor 10 in the positive direction with a predetermined rotation frequency (T10). Thereby, rotating force of the motor 10 is transmitted through the planet gear 47 to the gear 58 of the pump 51, to rotate the rotor 56. Then, as described above, ink is sucked through the suction inlet 53 of the pump 51, and ink contained in the pump 51 is discharged through the discharge outlet 54 into the ink-jet head 2, thus forcibly ejecting ink through the nozzles of the ink-jet heads 2. The ink is ejected from the ink-jet head 2 onto the frame 71 of the maintenance unit 70, moves from the frame 71 to the waste ink receiver 77, and drained through the ink outlet 77*a* of the waste ink receiver 77 into the waste ink reservoir (not shown).

After T10, whether the purge operation completes or not is determined (T11). If the purge operation completes (T11: YES), rotation of the motor 10 is stopped and the processing proceeds to T12. Driving of the motor 10 is stopped such that the rotation of the motor 10 stops at a time when the cut-off part 55*a* of the rotor 56 of the pump 51 takes a position where it locates in FIG. 4, that is, at a time when the suction inlet 53 and the discharge outlet 54 of the pump 51 communicate with each other.

In T12, the switching controller 115 controls the solenoid driver 126 so as to expand the shaft 63 of the solenoid 62 corresponding to the pump 51 which has performed the purge operation, to thereby move the planet gear 47 away from the gear 58. Here, a certain condition of engagement between the planet gear 47 and the gear 58 may forbid smooth disengagement of the planet gear 47 from the gear 58. Accordingly, after T12 as well as in T9, the negative rotation controller 117 controls the motor driver 122 so as to rotate the motor 10 slightly in the negative direction (T13). This enables the planet gear 47 and the gear 58 to be surely disengaged. Since the planet gear 47 and the gear 58 are disengaged like this, even if the motor 10 rotates in the positive or negative direction its rotation force is not transmitted to the pump 51 and therefore the pump 51 is not driven.

After T13, the control unit 101 determines, based on the purge signal received in T1, whether any other pump 51 should perform a purge operation or not (T14). If another pump 51 should perform a purge operation (T14: YES), the processing returns to T8 to make this pump 51 perform the same purge operation as described above.

Figure 11:
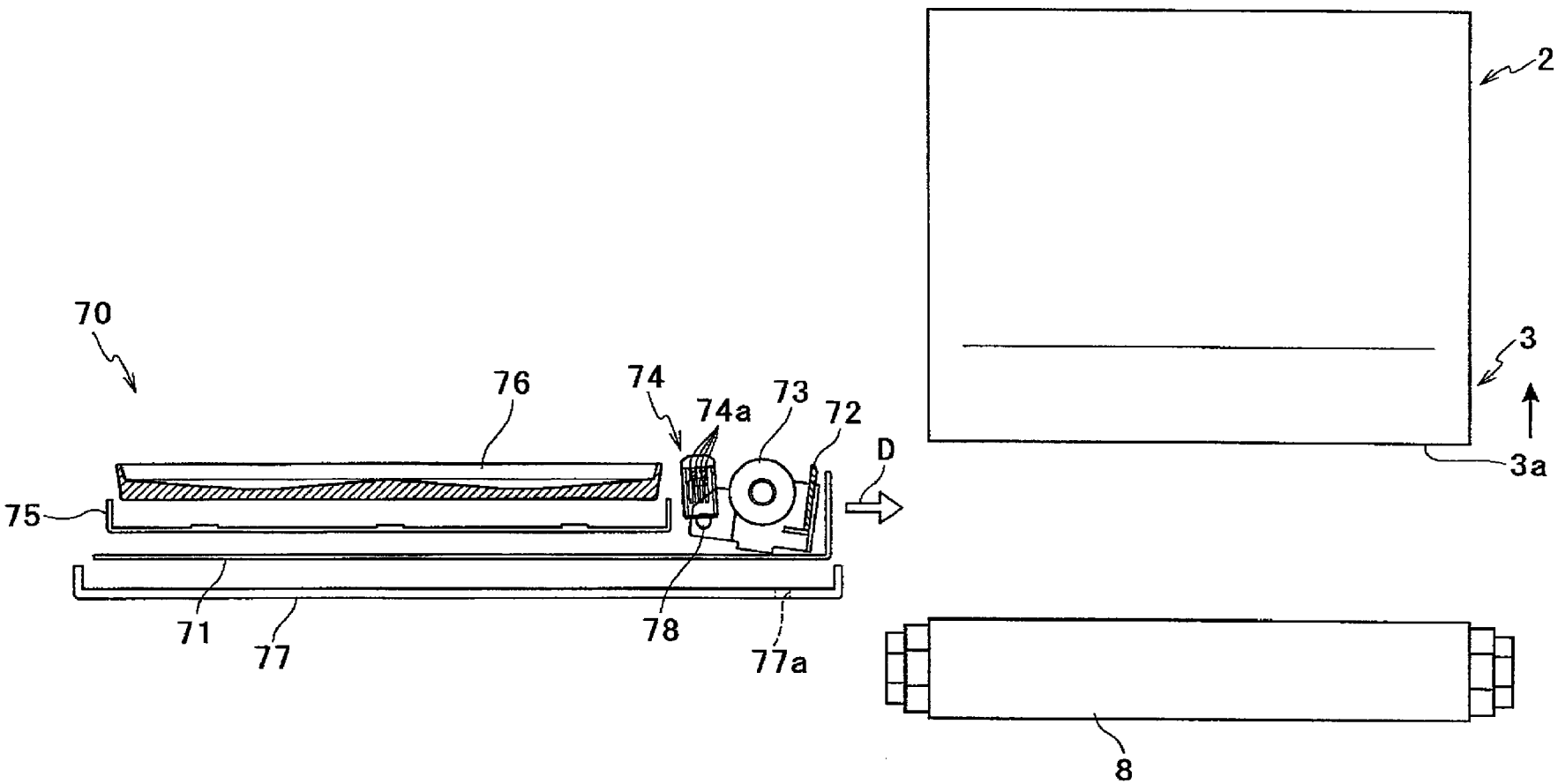
FIG. 11 shows an operating condition, in a purge operation, of an ink-jet head and a maintenance unit that are included in the ink-jet printer, in which the ink-jet head has moved in a maintenance position.
Figure 12:
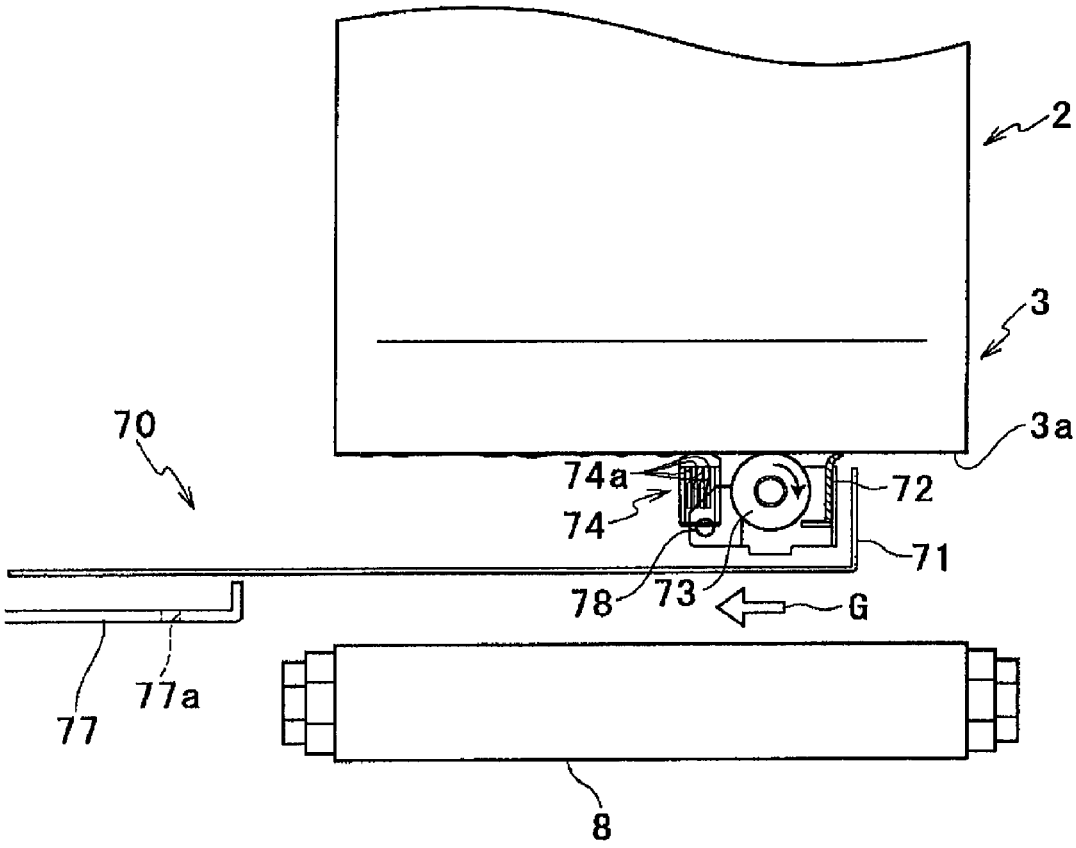
FIG. 12 shows an operating condition of the ink-jet head and the maintenance unit in a purge operation, in which the maintenance unit is wiping off ink adhering to an ink-ejection face.

If no pump 51 should perform a purge operation (T14: NO), a wiping operation which will be described below is performed (T15). At this time, the maintenance unit moving controller 119 controls the motor driver 124 so as to drive the motor 82, so that, as shown in FIG. 12, the maintenance unit 70 except the frame 75 and the caps 76 disposed within the frame 75 is moved in the direction of the arrow G from the "maintenance position" into the "withdrawal position". In this movement into the "withdrawal position", the wipe roller 73 and the blade 72 disposed in the frame 71 rotate on the shaft 78 from their position as shown in FIG. 11 into their position as shown in FIG. 12, that is, from a position not in contact with the ink ejection faces 3*a* into a position in contact with the ink ejection faces 3*a*. Then, along with the movement of the frame 71, a wiping operation is performed. More specifically, the ink receiving member 74, the wipe roller 73, and the blade 72 wipe off ink adhering to the ink ejection faces 3*a*.

Each thin plate 74*a* of the ink receiving member 74 has its upper end kept out of contact with the ink ejection faces 3*a* but disposed adjacent to the ink ejection faces 3*a* at a predetermined slight interval. Therefore, among ink adhering to the ink ejection faces 3*a*, relatively large droplets are transferred into between the thin plates 74*a* of the ink receiving member 74. As shown in FIG. 12, the wipe roller 73 comes into contact with the ink ejection faces 3*a*, and rotates clockwise in FIG. 12 along with movement of the frame 71 while wiping off smaller droplets which have not been removed by the ink receiving member 74. Since the wipe roller 73 is made of a porous material capable absorbing ink, the wiped-off ink existing on a surface of the wipe roller 73 is absorbed inside. An upper end of the blade 72 is higher than the ink ejection faces 3*a*. Therefore, while the blade 72 is in the position opposed to the ink ejection faces 3*a*, it comes into contact with the ink ejection faces 3*a* in a bending condition, to thereby scratch off the ink adhering to the ink ejection faces 3*a*. As a result, among the ink adhering to the ink ejection faces 3*a*, smaller droplets which have not been removed by the wipe roller 73 are wiped off.

Figure 13:
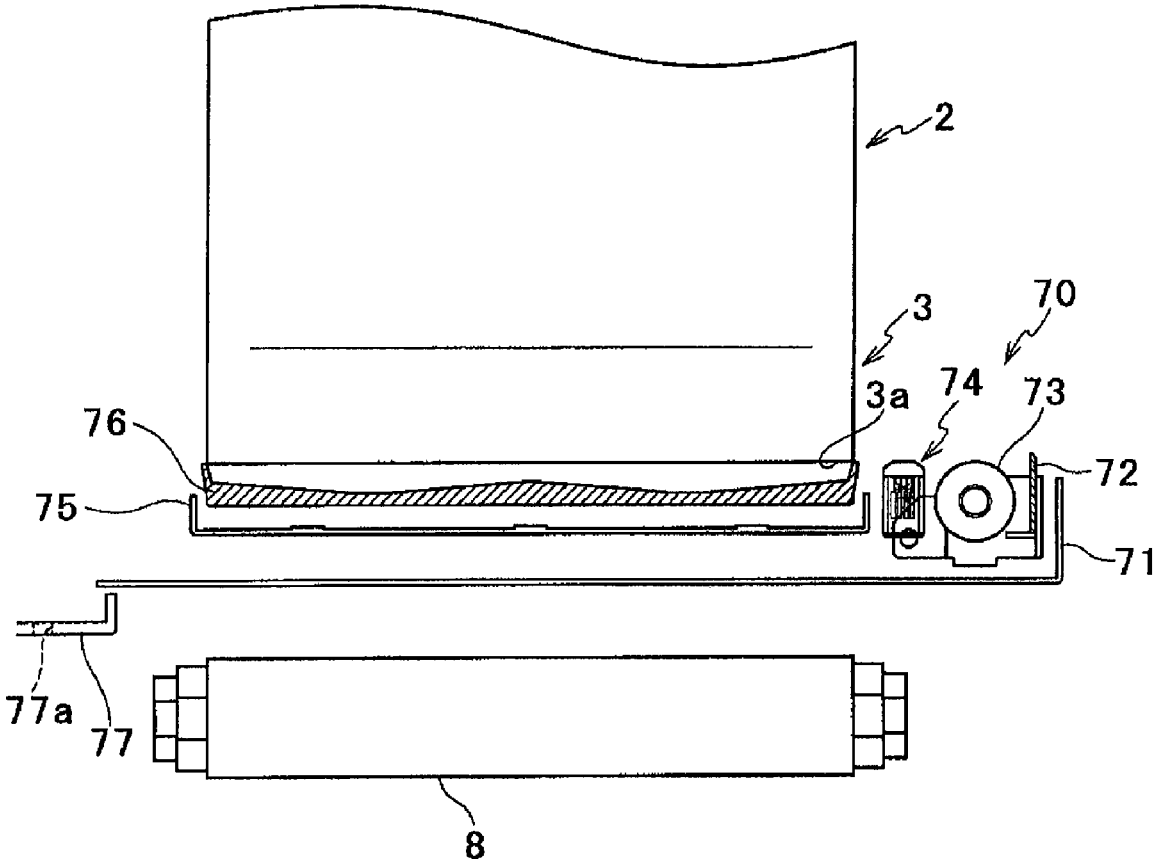
FIG. 13 shows an operating condition of the ink-jet head and the maintenance unit in a purge operation, in which the ink-ejection face is covered with a cap.

After T15, as shown in FIG. 13, the frame 75 and the caps 76 disposed within the frame 75 of the maintenance unit 70 comes below the ink ejection faces 3*a* of the heads 2 (T16).

More specifically, the frame 71 and the frame 75 are coupled by the hook mechanism, and the maintenance unit moving controller 119 controls the motor driver 124 so as to drive the motor 82. Thus, the frame 75 together with the frame 71 is horizontally moved, and the caps 76 are disposed so as to confront the respective ink ejection faces 3*a* of the corresponding heads 2. Then, the caps 76 are moved up into close contact with the ink ejection faces 3*a*, and thus cover the ink ejection faces 3*a*, in order to prevent the ink ejection faces 3*a* from drying up.

After T16, the elevator controller 114 controls the motor driver 125 so as to drive the motor 37, so that the supporter 26 is moved up and the uppermost one of the papers stacked within the paper tray 21 is brought into contact with the pick-up roller 22 (T17). Since, like this, the uppermost one of the papers stacked within the paper tray 21 is brought into contact with the pick-up roller 22, it is possible to feed a paper onto the conveyor belt 8 even immediately after the purge operation. For feeding a paper, the maintenance unit 70 is moved into the "withdrawal position" (see FIGS. 3 and 11), and the four ink-jet heads 2 are disposed in the "printing position" (see FIG. 3).

In the above-described ink-jet printer 1 of this embodiment, the pumps 51 and the pick-up roller 22 are driven separately in accordance with positive and negative rotation of the drive shaft 10*a* rotated by the motor 10. Accordingly, drive sources such as motors dedicated to the pump 51 and the pick-up roller 22 are not needed, and therefore the ink-jet printer 1 can be downsized.

Further, before the drive shaft 10*a* of the motor 10 is rotated in the positive direction to drive the pump 51, the supporter 26 is moved down in order that the uppermost one of the papers stacked on the supporter 26 of the paper tray 21 can be away from the pick-up roller 22 (T3 of FIG. 10). Therefore, even if at this time the drive shaft 10*a* of the motor 10 unintentionally rotates in the negative direction, a paper is not sent out to the conveyor belt 8. Thus, misfeeding of a paper can be prevented.

The ink-jet head 2 of the above embodiment is a line-type one, but it may be a serial-type one, too. Even when the present invention is applied to a serial-type ink-jet printer, the above-described effects can be obtained.

The number of heads included in the printer is not limited to four, and the printer is not limited to a color printer.

The present invention may not always be applied to an ink-jet printer, but may be applied to an ink-jet type facsimile or copying machine for example.

The driving force transmitter 40 is not limited to one including gears as described in the above embodiment, as long as it uses the same drive source in order to drive the pumps and the pick-up roller, and at the same time as long as driving of the pumps and the driving of the pick-up roller can be switched in accordance with a rotation direction of the drive shaft that is rotationally driven by this drive source. The driving force transmitter 40 may take other various configurations.

The holder 61 may not necessarily be connected to the solenoid 62. That is, it is also possible that expansion and contraction of the shaft 63 of the solenoid 62 is not relied on and only rotation of the drive shaft 10*a* is used in order to swing the holder 61 and the planet gear 47 held on the holder 61 such that the planet gear 47 may be spaced away from or engaged with the gear 58. In this case, it is not necessary to provide the switching controller 115 and the solenoid 62, and therefore constructions of the driving force transmitter 40 and the control unit 101 can be simplified.

It may not always necessary to stop rotation of the drive shaft 10*a* of the motor 10 before the planet gear 47 is moved into engagement with the gear 58. It may not always necessary to slightly rotate the drive shaft 10*a* of the motor 10 in the negative direction after the planet gear 47 is moved into engagement with the gear 58. It may not always necessary to move up the supporter 26 to bring the uppermost one of the papers stacked on the supporter 26 into contact with the pick-up roller 22, after a purge operation completes and the planet gear 47 is moved away from the gear 58.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

an ink-jet head that has an ink ejection face on which a plurality of nozzles for ejecting ink to a record medium are formed;

a conveyor mechanism that conveys the record medium to a position confronting the ink ejection face;

a supporter that supports a plurality of record media;

a pick-up roller that supplies to the conveyor mechanism an uppermost one of the record media supported on the supporter;

an elevator that moves up and down the supporter;

a pump that forcibly ejects through the nozzles ink staying within the ink-jet head;

a drive shaft that is rotated both in positive and negative directions by a drive source;

a driving force transmitter that is capable of switching its mode between a mode for transmitting rotating force of the drive shaft in the positive direction to the pump so as to drive the pump and a mode for transmitting rotating force of the drive shaft in the negative direction to the pick-up roller so as to drive the pick-up roller;

a purge controller that controls the drive source so as to rotate the drive shaft in the positive direction in order that the pump is driven to forcibly eject through the nozzles ink staying within the ink-jet head; and an elevator controller that controls the elevator so as to bring the uppermost one of the record media supported on the supporter to one of a position in contact with the pick-up roller and a position away from the pick-up roller, wherein, after the elevator controller controls the elevator so as to bring the uppermost one of the record media supported on the supporter to the position away from the pick-up roller, the purge controller controls the drive source so as to rotate the drive shaft in the positive direction.

2. The ink-jet recording apparatus according to claim 1, wherein the driving force transmitter includes:

a first sun gear that rotates together with the drive shaft;

a first planet gear that is engaged with the first sun gear and revolves around the first sun gear; and a first holder that holds the first planet gear in order that the first planet gear takes one of a first driving position to transmit rotating force of the drive shaft to the pick-up roller by being engaged with a pick-up roller gear that transmits rotating force to the pick-up roller and a first withdrawal position to be withdrawn from the first driving position.

3. The ink-jet recording apparatus according to claim 2, wherein the driving force transmitter further includes:

a second sun gear that rotates together with the drive shaft;

a second planet gear that is engaged with the second sun gear and revolves around the second sun gear; and a second holder that holds the second planet gear in order that the second planet gear takes one of a second driving position to transmit rotating force of the drive shaft to the pump by being engaged with a pump gear that transmits rotating force to the pump and a second withdrawal position to be withdrawn from the second driving position, wherein the second holder is connected to a switching mechanism that switches a position of the second planet gear to one of the second driving position and the second withdrawal position, and wherein the ink-jet recording apparatus further comprises a switching controller that, after the elevator controller controls the elevator so as to bring the uppermost one of the record media supported on the supporter to the position away from the pick-up roller, controls the switching mechanism so as to move the second planet gear into the second driving position.

4. The ink-jet recording apparatus according to claim 3, wherein, before the switching controller controls the switching mechanism so as to move the second planet gear into the second driving position, the purge controller controls the drive source so as to stop rotation of the drive shaft.

5. The ink-jet recording apparatus according to claim 4, wherein, after the switching controller controls the switching mechanism so as to move the second planet gear into the second driving position, the purge controller controls the drive source so as to rotate the drive shaft slightly in the negative direction.

6. The ink-jet recording apparatus according to claim 3, wherein:

a plurality of the ink-jet heads that eject ink of different colors and a plurality of the pumps corresponding to the respective ink-jet heads are provided;

a plurality of sets of the second sun gear, the second planet gear, the second holder, and the switching mechanism are provided so as to correspond to each of the pumps; and the switching controller controls the switching mechanism so as to move at least one second planet gear into the second driving position.

7. A method for driving an ink-jet recording apparatus comprising an ink-jet head that has an ink ejection face on which a plurality of nozzles for ejecting ink to a record medium are formed, a conveyor mechanism that conveys the record medium to a position confronting the ink ejection face, a supporter that supports a plurality of record media, a pick-up roller that supplies to the conveyor mechanism an uppermost one of the record media supported on the supporter, an elevator that moves up and down the supporter, a pump that forcibly ejects through the nozzles ink staying within the ink-jet head, a drive shaft that is rotated both in positive and negative directions by a drive source, a driving force transmitter that is capable of switching its mode between a mode for transmitting rotating force of the drive shaft in the positive direction to the pump so as to drive the pump and a mode for transmitting rotating force of the drive shaft in the negative direction to the pick-up roller so as to drive the pick-up roller, the method comprising:

a first elevator controlling step for controlling the elevator so that the uppermost one of the record media supported on the supporter is moved from a position in contact with the pick-up roller to a position away from the pick-up roller; and a purge controlling step for, after the first elevator controlling step, controlling the drive source so as to rotate the drive shaft in the positive direction so that the pump is driven to thereby forcibly eject through the nozzles ink staying within the ink-jet head.

8. The method according to claim 7, wherein the driving force transmitter includes:

a first sun gear that rotates together with the drive shaft;

a first planet gear that is engaged with the first sun gear and revolves around the first sun gear;

a first holder that holds the first planet gear in order that the first planet gear takes one of a first driving position to transmit rotating force of the drive shaft to the pick-up roller by being engaged with a pick-up roller gear that transmits rotating force to the pick-up roller and a first withdrawal position to be withdrawn from the first driving position;

a second sun gear that rotates together with the drive shaft;

a second planet gear that is engaged with the second sun gear and revolves around the second sun gear; and a second holder that holds the second planet gear in order that the second planet gear takes one of a second driving position to transmit rotating force of the drive shaft to the pump by being engaged with a pump gear that transmits rotating force to the pump and a second withdrawal position to be withdrawn from the second driving position, wherein the second holder is connected to a switching mechanism that switches a position of the second planet gear to one of the second driving position and the second withdrawal position, and wherein the method further comprises:

a first switch controlling step for, after the first elevator controlling step and before the purge controlling step, controlling the switching mechanism so as to move the second planet gear into the second driving position; and a second switch controlling step for, after the purge controlling step, controlling the switching mechanism so as to move the second planet gear, which has been moved in the first switch controlling step, into the second withdrawal position.

9. The method according to claim 8, further comprising a rotation-stop controlling step for, after the first elevator controlling step and before the first switch controlling step, controlling the drive source so as to stop rotation of the drive shaft.

10. The method according to claim 8, further comprising a negative rotation controlling step for, after the first switch controlling step and before the purge controlling step, controlling the drive source so as to rotate the drive shaft slightly in the negative direction.

11. The method according to claim 8, further comprising a second elevator controlling step for, after the second switch controlling step, controlling the elevator so that the uppermost one of the record media supported on the supporter is moved from the position away from the pick-up roller to the position in contact with the pick-up roller.

12. The method according to claim 8, wherein:

the ink-jet recording apparatus has a plurality of the ink-jet heads that eject ink of different colors, and a plurality of the pumps corresponding to the respective ink-jet heads;

a plurality of sets of the second sun gear, the second planet gear, the second holder, and the switching mechanism are provided so as to correspond to each of the pumps; and in the first switch controlling step, the switching mechanism is controlled so as to move at least one second planet gear into the second driving position.

* * * * *